US005191975A

United States Patent [19]

Pezzoli et al.

[11] Patent Number: 5,191,975

[45] Date of Patent: Mar. 9, 1993

[54] PACKAGING DEVICE AND PACKAGING ASSEMBLY

[75] Inventors: Paul A. Pezzoli, Worthington; Antonino Araujo, Jr., Arlington; Raymond W. Hazlett, Sugar Grove, all of Ohio

[73] Assignee: Abbott Laboratories, Abbott Park, Ill.

[21] Appl. No.: 627,152

[22] Filed: Dec. 13, 1990

[51] Int. Cl.[5] ..... B65D 75/00; B66C 1/42

[52] U.S. Cl. ..... 206/151; 206/159; 206/427; 294/87.2

[58] Field of Search ..... 206/145, 147, 150, 155, 206/158, 201, 427, 431, 151, 159; 294/87.2; 211/74; 53/398, 48.2, 48.1

[56] References Cited

U.S. PATENT DOCUMENTS

| | | | |
|---|---|---|---|
| 2,466,195 | 4/1949 | Anderson et al. | 211/89 |
| 2,591,041 | 4/1952 | Berg | 211/86 |
| 2,637,475 | 5/1953 | Gialanella | 294/87.2 X |
| 2,865,669 | 12/1958 | Linthicum | 294/87.2 |
| 2,871,055 | 1/1959 | Glazer | 294/87.2 |
| 2,879,100 | 3/1959 | Moore | 294/87.2 |
| 2,996,329 | 8/1961 | Glazer | 294/87.2 |
| 3,003,805 | 8/1961 | Glazer | 206/147 X |
| 3,028,189 | 4/1962 | Gialanella | 206/145 X |
| 3,036,853 | 5/1962 | Glazer | 294/87.2 |
| 3,611,656 | 10/1971 | Chidsey, Jr. | 53/398 |
| 3,664,496 | 5/1972 | Mascia | 206/151 |
| 3,710,535 | 1/1973 | Walter | 53/398 |
| 3,888,348 | 6/1975 | Frey | 206/427 |
| 3,913,778 | 10/1975 | Oglesbee | 211/74 X |
| 3,946,877 | 3/1976 | Galicia | 211/65 |
| 3,951,259 | 4/1976 | Oglesbee | 206/427 X |
| 4,503,657 | 3/1985 | Osteen | 53/48.1 |
| 4,523,677 | 6/1985 | Schurmann | 206/158 |
| 4,560,064 | 12/1985 | Peterson et al. | 206/159 |
| 4,569,440 | 2/1986 | Steiger | 294/87.2 X |
| 4,769,749 | 9/1988 | Felski | 362/250 |
| 4,807,421 | 2/1989 | Araki et al. | 53/167 |

FOREIGN PATENT DOCUMENTS

| | | | |
|---|---|---|---|
| 209937 | 2/1957 | Australia | 294/87.2 |
| 2144334 | 3/1973 | Fed. Rep. of Germany | 294/87.2 |
| 2163344 | 2/1986 | United Kingdom | 294/87.2 |

OTHER PUBLICATIONS

U.S. patent application Ser. No. 07/626,869, filed Dec. 1990, "Bottle and Cap", Pezzoli et al.

U.S. patent application Ser. No. 07/626,870, filed Dec. 1990, "Bottle and Cap", Osip et al.

U.S. patent application Ser. No. 07/627,871, filed Dec. 1990, "Packaging Clip" Pezzoli et al.

U.S. patent application Ser. No. 07/626,872, filed Dec. 1990, "Packaging Clip", Araujo, Jr. et al.

U.S. patent application Ser. No. 07/626,873, filed Dec. 1990, "Bottle", Osip et al.

U.S. patent application Ser. No. 07/626,874, filed Dec. 1990, "Assembly of Packaing Clip and Bottles", Araujo, Jr. et al.

U.S. patent application Ser. No. 07/626,875, filed Dec. 1990, "Bottle", Pezzoli et al.

U.S. patent application Ser. No. 07/626,876, filed Dec. 1990, "Packaging Clip", Hazlett et al.

*Primary Examiner*—Steven N. Meyers
*Assistant Examiner*—Beth Anne Cicconi
*Attorney, Agent, or Firm*—Lonnie R. Drayer; Donald O. Nickey

[57] ABSTRACT

A packaging device for use in retaining a plurality of containers comprises a longitudinal central section and a plurality of means for gripping containers. Preferably the gripping means comprise pairs of resilient flexible prongs, with these pairs of prongs arranged along opposite sides of the longitudinal central section. A packaging assembly for retaining and distributing containers, which packaging assembly includes the packaging device, is also disclosed.

23 Claims, 19 Drawing Sheets

PACKAGING DEVICE AND PACKAGING ASSEMBLY

TECHNICAL FIELD

The present invention relates generally to a packaging device and more particularly to a packaging device provided with clip components for retaining containers in a desired formation and a packaging assembly utilizing the device.

BACKGROUND OF THE INVENTION

The liquid nutritional industry, as well as the packaging industry in general, has long sought to provide improved packaging assemblies for retaining and distributing liquid products as well as a packaging device which as a component of a packaging assembly facilitates the stabilization of containers during shipment, the unitizing of containers for distribution, as well as an efficient device to assist in the distribution of such containers. This invention solves those long-felt needs. The packaging device may also be used for collecting empty containers or may be re-used with other similarly dimensioned containers.

Hospitals have encountered problems relating to the distribution of liquid products in plastic or glass containers to patients by medical personnel. These problems are particularly acute in the maternity area. For example, at one time, the feeding of newborn infants was the responsibility of the nursing staff. Now, however, it is a common practice to have the mothers feed their infants. This feeding of a liquid nutritional product is often accomplished by having hospital personnel distribute containers of liquid nutritional product to the mothers. This distribution may include the providing of multiple containers of food products to certain mothers. Additionally, specific dietary formulations, which may include medication, may be utilized. Still further, various feeding cycles may be involved in a maternity section of a hospital. Thus, for a variety of reasons it is desirable to be able to provide a number of bottles to the mothers of newborns for their use, as well as having a way to systematically identify those containers which have been customized as to their nutritional formulation.

Liquid nutritional products, such as infant formula or juice often are provided in containers of an individual serving size. These individual serving containers have typically been packaged in either a closed paperboard carton or in conjunction with a paperboard tray, which then along with the nutritional product containers is covered with a plastic film.

Unfortunately, once the plastic film has been removed or the closed, paperboard carton has been opened, significant problems arise concerning the retention and distribution of the containers. For example, once the plastic film is removed from a paperboard tray, the tray often does not have sufficient rigidity to hold the containers securely. The weight of the containers often causes the tray to bend, which may eventually result in the containers eventually falling from the tray. This is especially true during distribution of the containers, since it involves the carrying a plurality of containers in the tray at one time.

It is thus apparent that the need exists for an improved device for use in a packaging assembly for retaining and distributing containers of liquid product which permits an extremely effective packaging device to be formed while being sensitive to fabrication and raw material costs. It is also apparent that the need exists for a packaging device which functions as a means to stabilize containers during shipment, display containers while in inventory, distribute containers, and when desired permit the restorage of empty containers, with this packaging device also being able to permit organization with respect to the containers. It is also apparent that the above mentioned needs exist with respect to a variety of products such as nutritional products, soft drinks and even motor oil.

Similarly, with respect to the closed paperboard cartons, once a carton is opened for purposes of distribution of the containers, it often becomes difficult to ascertain how many containers are left to be distributed. Furthermore, after distribution of the product in the containers, if it is desired to collect the empty containers, an opened paperboard carton often precludes convenient re-storage of the empty containers.

U.S. Pat. No. 4,769,749 teaches a mounting device for supporting a string of decorative lights, such as Christmas tree lights. The device comprises a platen-like strip with cutouts extending along and opening to the edges. However, the light bulbs and sockets are inserted into the cutouts endwise, with the openings at the side edges of the strip being slightly greater than the conducting cord of the string of lights.

U.S. Pat. No. 3,946,877 teaches a clip-type holder for toothbrushes or the like. The means for gripping the toothbrushes are pairs of prongs, but the device is intended for mounting on a wall or similar surface so there is no suggestion that there should be a second row of gripping means extending from the opposite side of the base strip. The use of a row of clip devices attached to a single side of a base strip is also taught in U.S. Pat. No. 2,466,195 for a "SHIRT AND TROUSER RACK" and U.S. Pat. No. 2,591,041 for a "DERBY AND MUTE RACK HOLDER".

U.S. Pat. No. 4,807,421 teaches a container holder having special utility during the process of bottling products. The central portion of the holding member is divided into several tongues and a central hole surrounded by these tongues is formed. However, there is no teaching in this patent that a number of containers may be retained by a single device.

One attempt to address the problems relating to the retention and distribution of containers, such as bottles, is taught in U.S. Pat. No. 4,523,677 issued to Schurmann. That patent discloses a molded plastic bottle holder wherein individual rib sections are provided for receiving respective necks of bottles. Each of the individual rib sections carry a number of segmental flexible lip members extending upwardly and inwardly to receive the neck of a bottle, with wedge shaped members carried by marginal portions of the flexible lip members so as to define an opening and add rigidity at the opening to facilitate removal of a bottle from the bottle holder while ensuring adequate gripping action during handling. That type of bottle holder has limitations with respect to the ease of distribution and subsequent optional re-storage. Additionally, the bottle holder as taught by Schurmann requires a relatively complex mold and a relatively large amount of plastic in order to suitably retain a plurality of containers.

SUMMARY OF THE INVENTION

The present invention provides a packaging assembly for retaining and distributing containers as well as a packaging device for use in retaining a plurality of containers, which device as a component of the assembly permits the easy stabilization of such containers during shipment, the unitizing of the containers for distribution, as well as an efficient device to assist in the distribution of containers of liquid product. At the same time, this present invention is extremely easy to make, and cost effective to produce.

There is provided in accordance with one aspect of the invention a packaging device for retaining a plurality of containers, with said device comprising a longitudinal central section and a plurality of means for gripping containers integral therewith. Each of the gripping means comprises a pair of opposed resilient gripping members. Opposite sides of the longitudinal central section have at least one of the pairs of gripping members extending therefrom. Each gripping member of each of the pairs of gripping members has a gripping surface and each pair of gripping members forms an opening for receiving and retaining a container.

There is provided in accordance with another aspect of the invention a packaging assembly comprising a packaging device and two rows of containers. The packaging device comprises a longitudinal central section and a plurality of means for gripping containers integral therewith. Each of the gripping means comprises a pair of opposed resilient gripping members. Opposite sides of the longitudinal central section having at least one of the pairs of gripping members extending therefrom. Each gripping member of each of the pairs of gripping members presents a gripping surface such that each of the pairs of gripping members forms an opening having a container retained therein.

Other aspects and advantages of the invention will be apparent from the following description, the accompanying drawings and the appended claims.

DETAILED DESCRIPTION OF THE INVENTION

Figure 1:
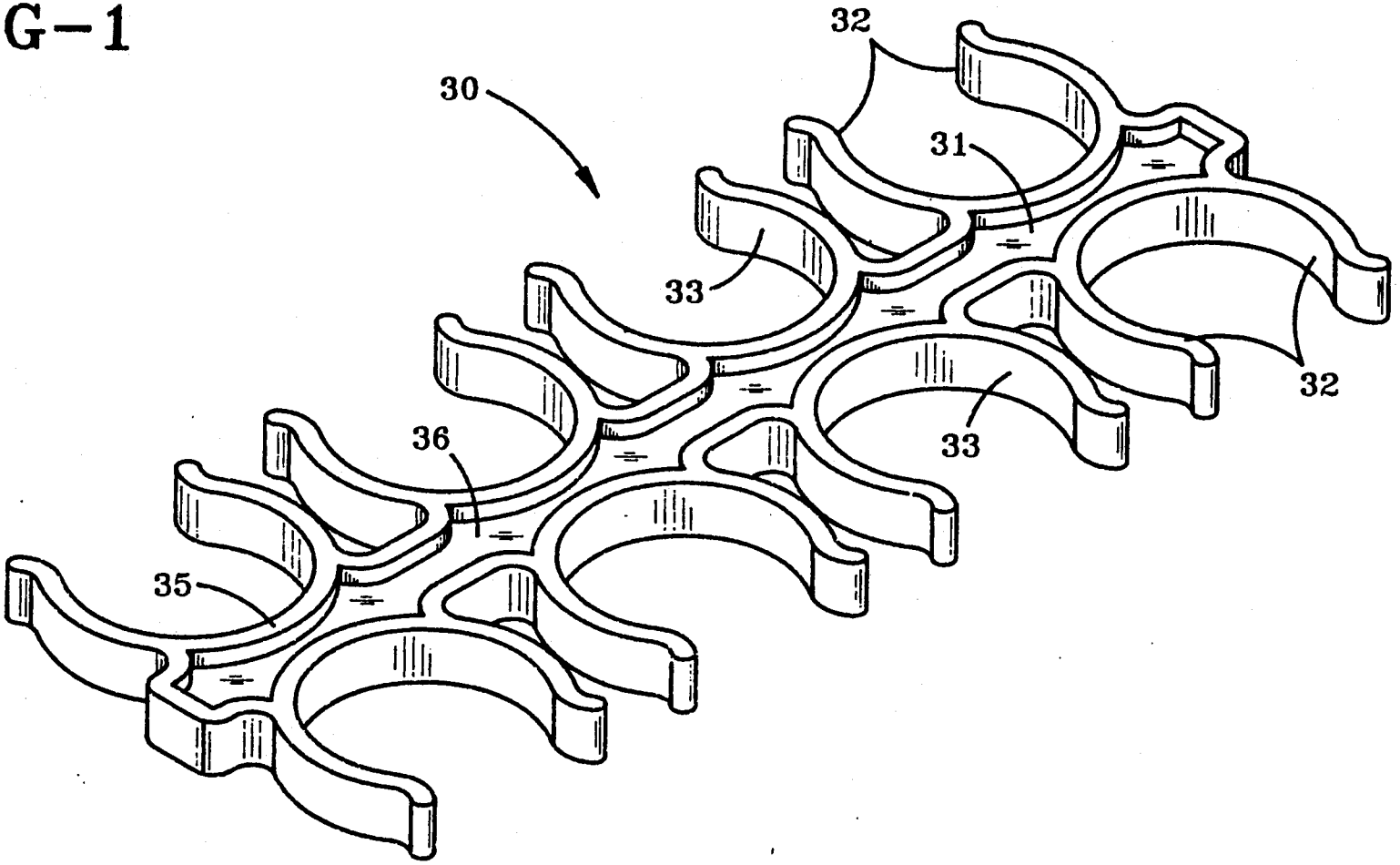
FIG. 1 is a perspective view of a packaging clip in accordance with a preferred embodiment of the invention.
Figure 3:
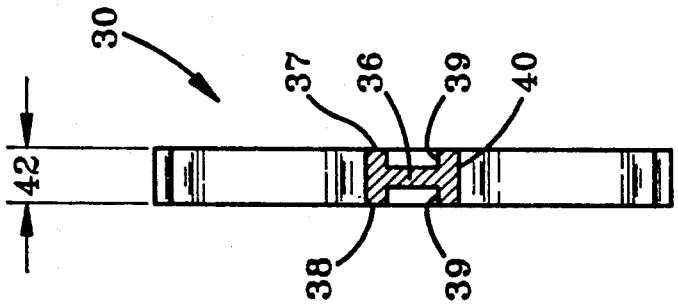
FIG. 3 is a cross sectional view of the packaging clip shown in FIG. 1, taken along line 3—3 of FIG. 2.
Figure 2:
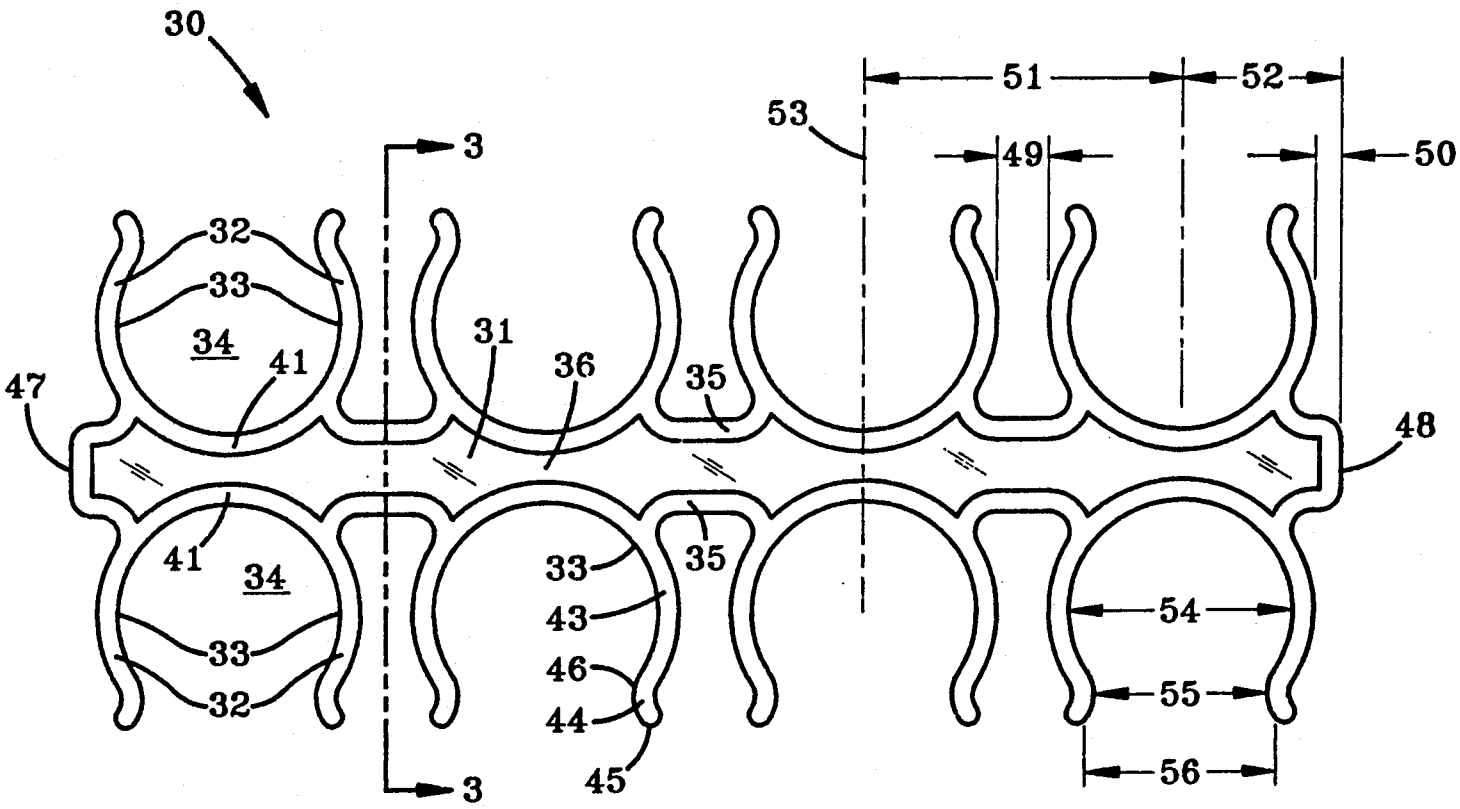
FIG. 2 is a top plan view of the packaging clip shown in FIG. 1.

Referring first to FIGS. 1–3, there is shown a packaging device 30 in accordance with a preferred embodiment of the invention. In accordance with the broadest aspect of the invention, a packaging device which has utility for retaining a plurality of containers in a desired formation is a clip type of device comprising a longitudinal central section 31 having a plurality of means 32 for gripping containers integral therewith. As used herein and in the claims "plurality" is understood to mean two or more. Each of the gripping means 32 comprises a pair of opposed resilient gripping members with opposite sides of the longitudinal central section 31 having at least one of the pairs of gripping members extending therefrom. As used herein and in the claims a "longitudinal side" or "side" of the longitudinal central section is one of the longer sides of the central section as opposed to the shorter ends of the central section. Each gripping member 32 of each of the pairs of gripping members has a gripping surface 33 which is shaped to be complementary with respect to the outer surface of the container which is to be gripped and each pair of gripping members forms an opening 34 which has utility for receiving and retaining a container.

In the preferred embodiment which is shown in FIGS. 1–3, the longitudinal central section 31 comprises a peripheral wall 35 which surrounds an interior support portion 36. As best seen in FIG. 3, which is a cross sectional view of the packaging device taken along line 3—3 of FIG. 2, the peripheral wall 35 has a top 37, a bottom 38, an inner face 39 and an outer face 40. The interior support portion 36 is a planar sheetform member which communicates with the inner face 39 of the peripheral wall 35 intermediate the top 37 and bottom 38 of the peripheral wall. That is to say, the peripheral wall 35 extends beyond both sides of the interior support portion 36 and preferably the gripping members 32 have the same height as the peripheral wall. In the preferred embodiment the peripheral wall extends beyond each side of the interior support portion about the same distance, such that the interior support portion 36 is midway between the top 37 and bottom 38 of the peripheral wall 35.

In the preferred embodiment illustrated in FIGS. 1–3, the means for gripping containers comprise pairs of opposed resilient prongs 32 which are integral extensions of the peripheral wall 35. A plurality of the pairs of prongs are arranged along opposite sides of the longitudinal central section. In other words, a number of pairs of gripping means, in this embodiment opposed resilient prongs, are arranged along each of the longitudinal sides of the longitudinal central section of the packaging device. Each prong of each of the pairs of prongs has a gripping surface 33 which is concave with respect to the other prong of the same pair, such that each pair of prongs forms an opening 34 for receiving and retaining a container. Put another way, in this preferred embodiment each pair of opposed resilient prongs 32 and a portion 41 of the peripheral wall 35 cooperate to form a "C" shaped opening 34 for receiving and retaining a container. A most preferred embodiment of the packaging device, has four pairs of prongs 32 disposed on each longitudinal side of the longitudinal central section 31. However; the number of pairs of prongs employed is dependent upon the number of containers desired in a packaging assembly. The gripping surfaces 33 of the prongs 32 which are in contact with containers, such as bottles, experience frictional grasping of the containers as a consequence of the resilient characteristic of the prongs. The height, of the peripheral wall 35 and the prongs 32 is preferably uniform as indicated at 42 in FIG. 3. In actual use, the height 42 should be sufficient to provide adequate surface contact between the container to be retained and the gripping surfaces 33. A height of approximately ⅜" has been found to be acceptable for retaining bottles containing several ounces of a liquid nutritional product. Most preferably, a packaging device according to the invention is unitary inasmuch as the longitudinal central section and the gripping means are integrally formed.

Preferably each of the prongs 32 comprising the gripping means is formed having a first prong portion 43 which is concave relative to the other prong of the same pair and also includes a second prong portion 44 which is angled relative to the first prong portion and which second prong portion terminates in a prong end 45, which prong end preferably is slightly rounded. Preferred embodiments of packaging devices according to the present invention are further characterized by the gripping surface 33 of each prong 32 having an end 46 which is distal from the longitudinal central section 31 of the device, with the prong continuing to extend enterally outwardly therefrom to the prong end 45. For each pair of prongs, beginning at the distal ends 46 of the gripping surfaces 33 of the prongs the distance between the prongs of the pair, as measured parallel to the longitudinal axis of the longitudinal central section 31, progressively increases as the distance from the longitudinal central section increases. As will be more fully explained later in this document this feature functions as a guide for directing containers into the opening which is presented by a pair of prongs, and is especially advantageous when automated equipment is employed for assembling containers with the packaging device.

As shown in all of the embodiments illustrated in the drawings, packaging clips according to the present invention preferably have the gripping means arranged such that the openings formed by pairs of gripping means on opposite sides of the longitudinal central portion are aligned with common centerlines, as shown at centerline 53 in FIG. 2. That is to say, preferably a packaging clip according to the invention is symmetrical with respect to a longitudinal axis of the longitudinal central section.

Preferred embodiments of packaging devices according to the present invention are further characterized by certain dimensional relationships which are advantageous when automated equipment is employed for assembling containers with the packaging devices, as will be more fully described later in this document. The longitudinal central section 31 of the device has a pair of opposed longitudinal ends 47, 48. Next adjacent pairs of prongs are spaced apart by a minimum distance 49, as measured parallel to the longitudinal axis of the longitudinal central section. With respect to each of the longitudinal ends 47, 48 the minimum distance 50, as measured parallel to the longitudinal axis of the longitudinal central section, between a longitudinal end 47, 48, and the nearest prongs is substantially equal, and most preferably equal, to one half of the minimum distance 49 between next adjacent pairs of prongs. Put another way, the distance 51 between the centerlines of the openings formed by next adjacent pairs of prongs, as measured parallel to the longitudinal axis of the longitudinal central section, is substantially, and most preferably exactly, twice as large as the distance 52 between each end 47, 48 of the longitudinal central section and the centerline of the openings formed by the nearest pairs of prongs, as measured parallel to the longitudinal axis of the longitudinal central section.

The gripping surfaces 33 of the prongs of each pair of prongs are spaced apart a maximum distance 54 and a minimum distance 55. The width 55 of the mouth of the opening 34 formed by the prongs should be in the range of 70% to 85% of the maximum width 54 of the opening. The exact ratio of these dimensions 54, 55 with respect to one another is of course dependent upon the material of which the packaging clip is formed. This ratio is however critical because it allows a container to be forced through the mouth of the opening in a direction perpendicular to the longitudinal axis of the longitudinal central section of the packaging device, while allowing the prongs to grip the container and retain it in place. While it is understood that the contour of the gripping surfaces of the prongs may be adapted to be complementary with the exterior of a container which is to be retained by the packaging device, it is desirable that the distance between the gripping surfaces of a pair of prongs be in the range of 0.9 to 1.05 times the width of the container at each location such that the container is gripped sufficiently securely. All of the packaging devices illustrated in the drawings have pairs of prongs which are configured for gripping containers having curved exteriors. For example, a packaging device according to this embodiment made of polypropylene and intended for use with cylindrical containers having an outside diameter of about 3.3 cm (1.3 inch), has a dimension 54 of about 3.1 cm (1.2 inch) and a dimension 55 of about 2.4 cm (0.96 inch), and the distance 56 between the prongs ends is about 2.9 cm (1.1 inch).

Figure 24:
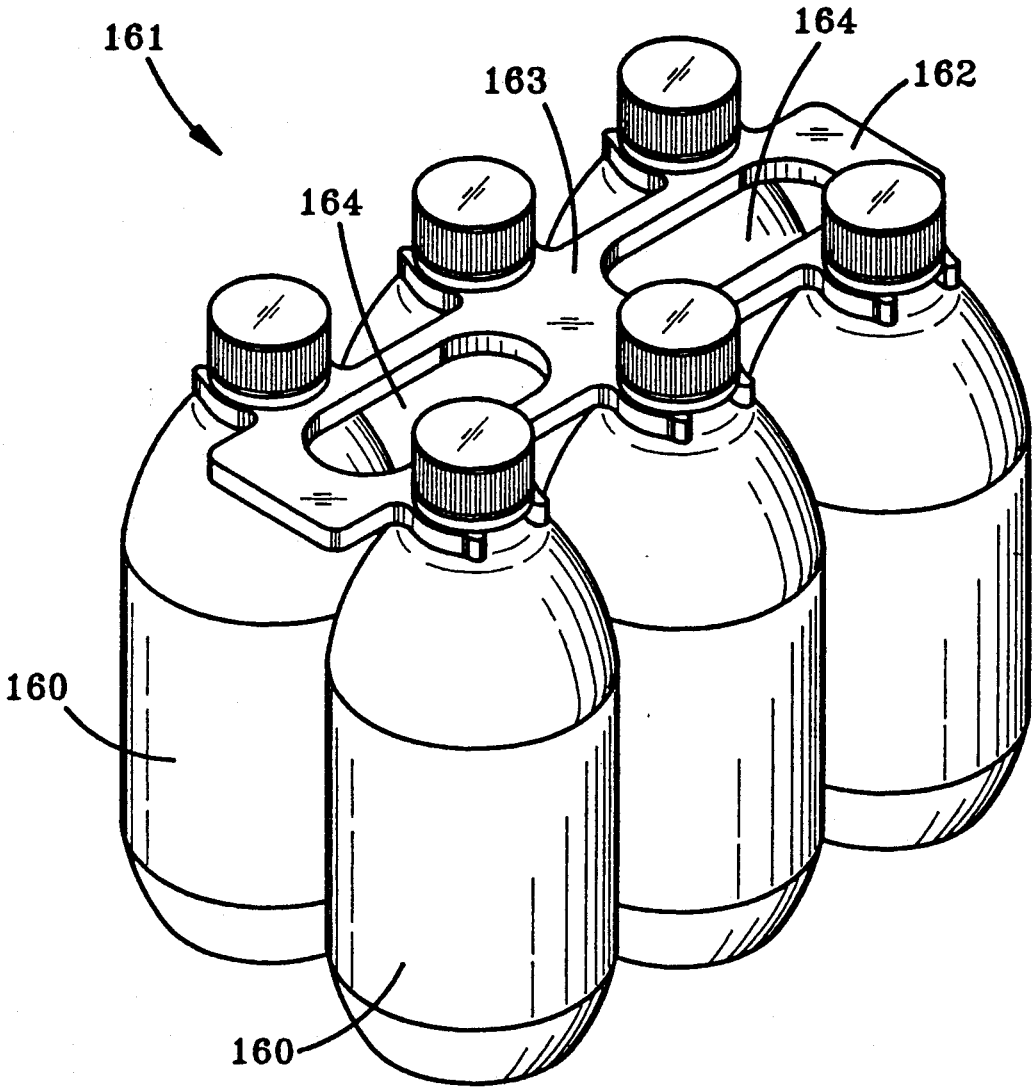
Figure 25:
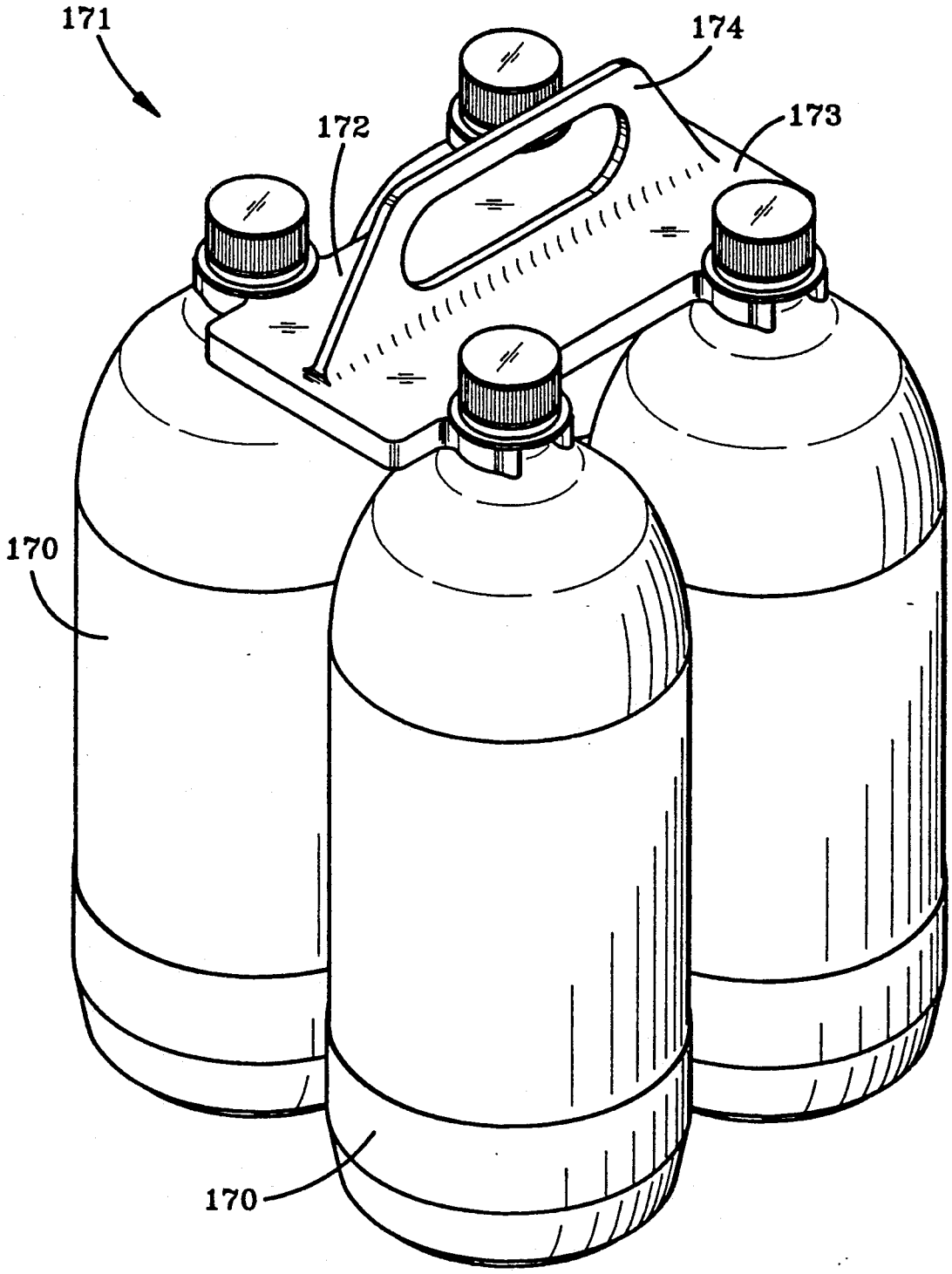

It is to be noted that for any packaging device in accordance with the present invention the dimensions of the longitudinal central section and the gripping means are dependent upon the dimensions of the containers which are intended to be retained by the device. Furthermore, as illustrated in FIG. 24, the device may have apertures 164 through the longitudinal central section adapted for carrying a packaging assembly, or, as illustrated in FIG. 25, the device may have an integral handle 174.

Figure 13:
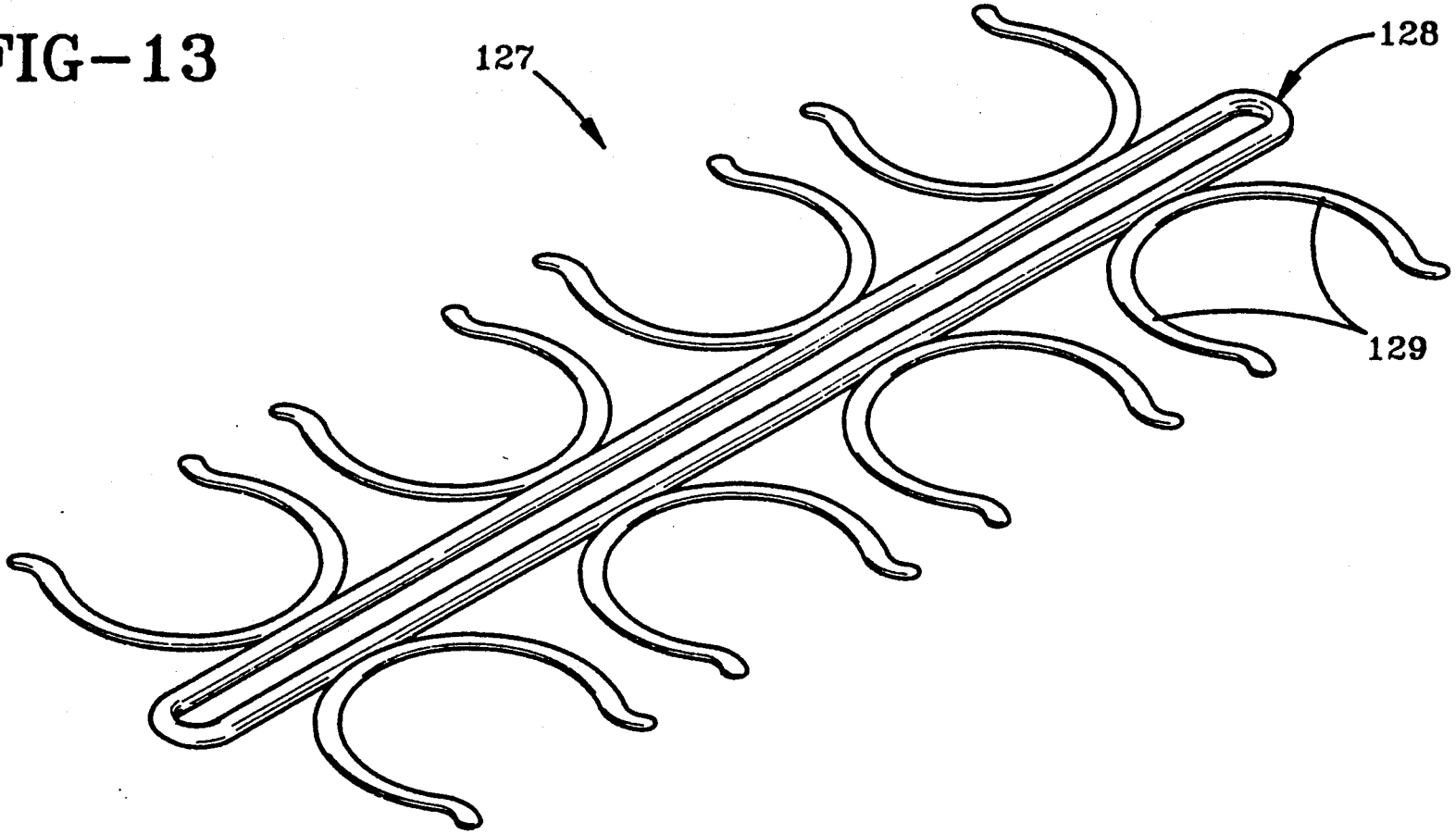
Figure 14:
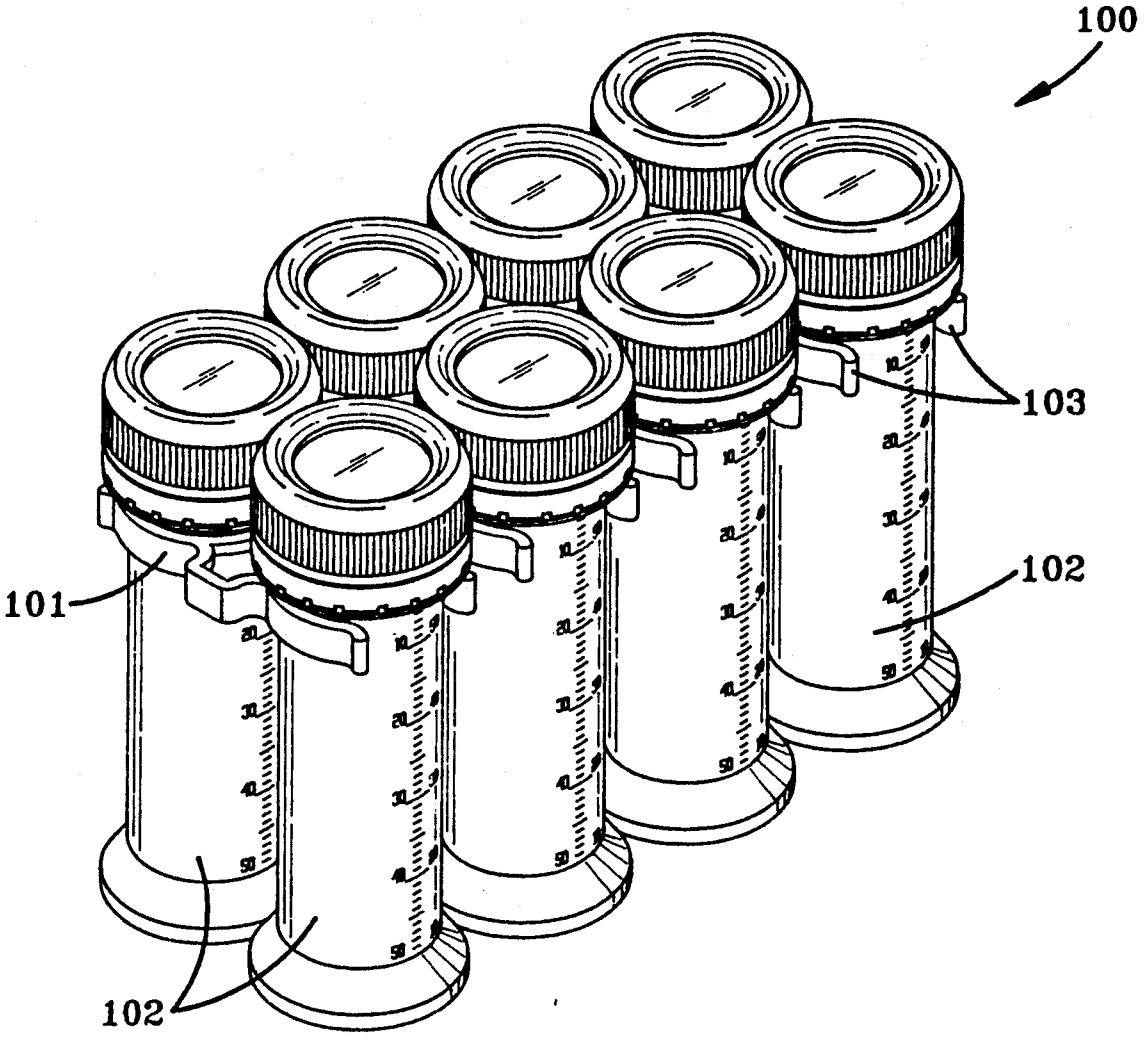
FIGS. 14–17 illustrate packaging assemblies according to the invention.
Figure 15:
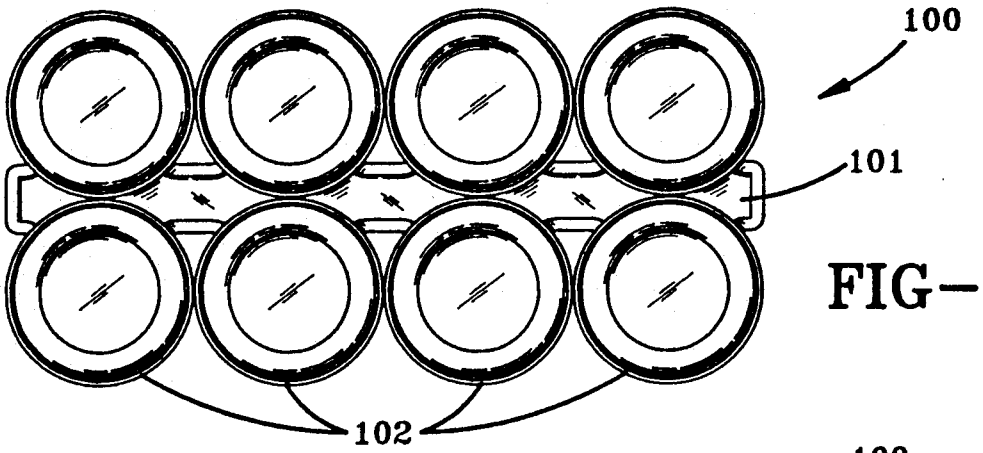
Figure 17:
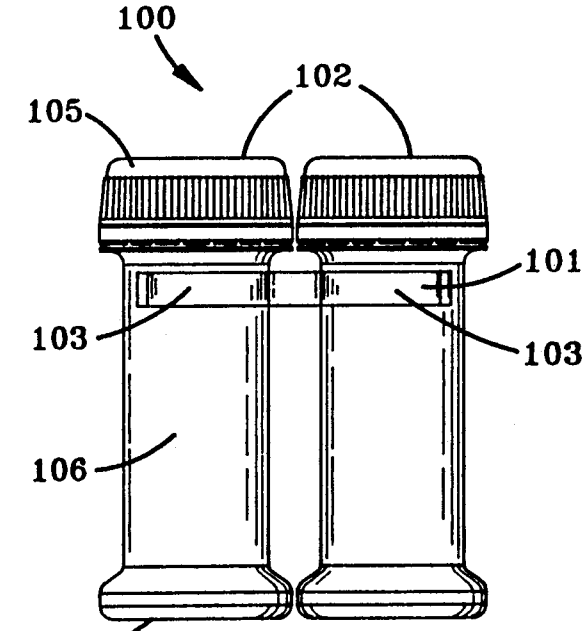
Figure 16:
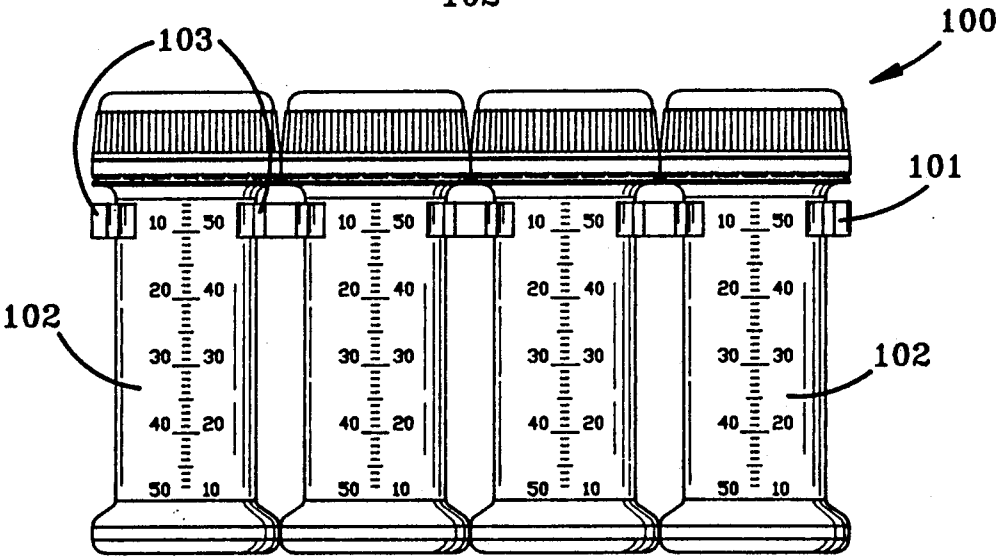

A packaging device according to the invention is preferably made of a material selected from the group consisting of polypropylene, polystyrene, polyethylene, and ABS plastic. Although the above types of plastic are specifically mentioned, other types of plastic may be employed in the manufacture of the packaging device provided that the means for gripping are resiliently flexible. However, it is understood that a packaging device according to the invention may comprise any suitable material including for example metallic wire bent into a suitable configuration as shown in FIG. 13. One advantageous feature of a packaging device according to the invention is that it is believed to be very appropriate to use recycled plastic, sometimes referred to as "regrind" in the manufacture of the packaging device.

The use of packaging devices and packaging assemblies of the present invention along with consumer awareness and education may be expected to encourage and facilitate litter reduction and increase recycling by making it more convenient to collect and transport empty containers. In fact reminders such as "Don't litter, collect and deposit empty containers in a suitable place" or "Collect empty containers for recycling" could easily be embossed on the packaging device. Not to mention that the packaging device may be recyclable. At the same time, the present invention is extremely easy to make, and cost effective to produce. The advantages associated with this invention would be found to be extremely beneficial in the liquid nutritional packaging industry as well as in locations where liquid nutritional product is distributed in containers, such as hospitals.

Figure 4:
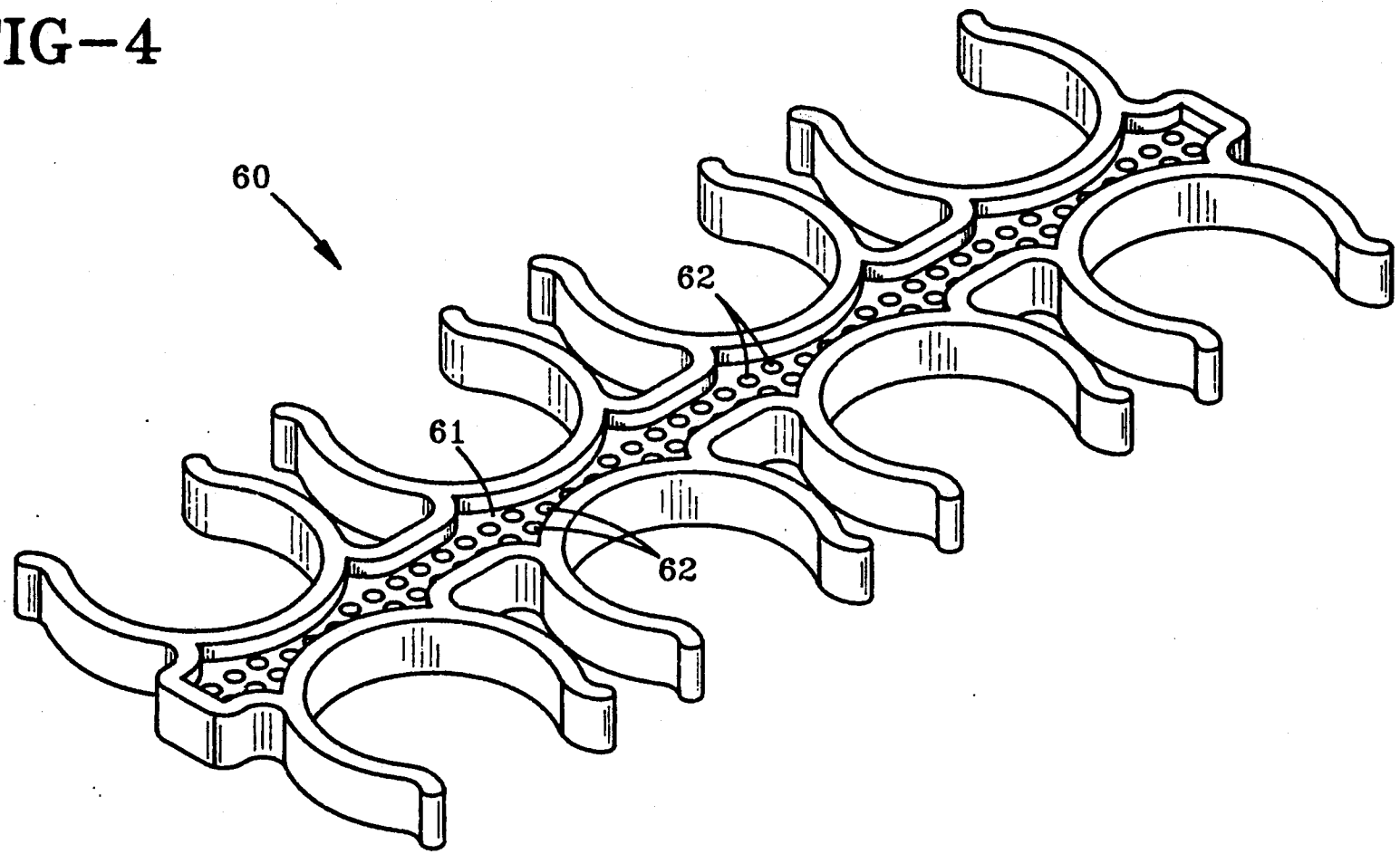
FIGS. 4–13 illustrate packaging clips according to alternative embodiments of the invention.

Referring next to FIG. 4, there is shown a packaging device 60 which is identical to the preferred embodiment illustrated in FIGS. 1-3 with the exception that the interior support portion 61 is fabricated with a plurality of apertures 62 formed therein. The presence of these apertures serves to further minimize the weight and material cost associated with the packaging device.

Figures 5, 6:
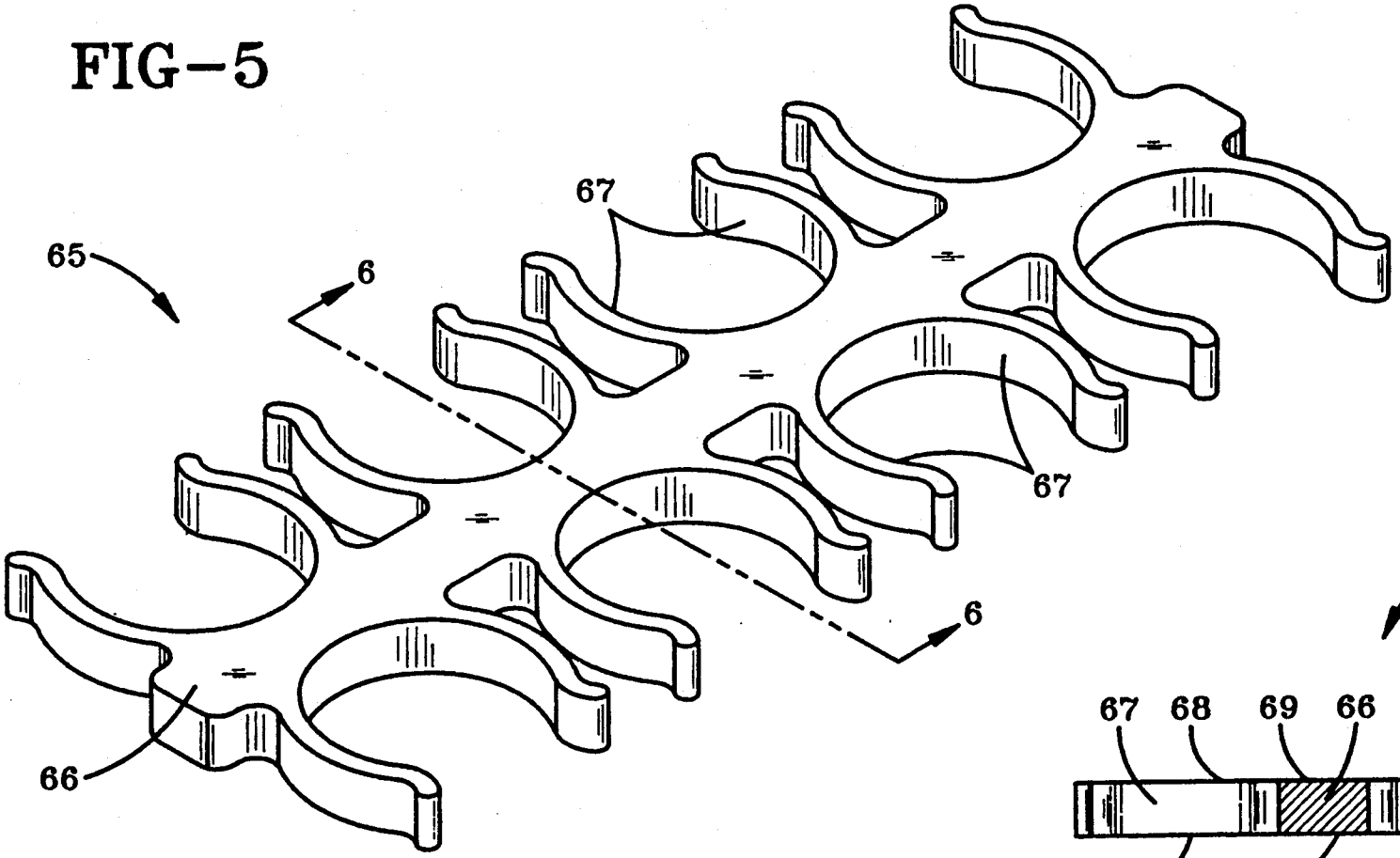

FIG. 5 shows another alternative embodiment of a packaging device 65 according to the present invention, and FIG. 6 is a cross sectional view of the device taken along line 6—6 of FIG. 5. The packaging device is very similar to the embodiment shown in FIGS. 1-3, but there is no peripheral wall surrounding a planar sheet-form central section as in the earlier described embodiment. However; this embodiment does have a longitudinal central section 66 with a plurality of pairs of opposed resilient prongs 67 arranged along opposite sides of said longitudinal central section and integral therewith. The top surfaces 68 of the prongs are a continuation of the top surface 69 of the longitudinal central section, and the bottom surfaces 70 of the prongs are a continuation of the bottom surface 71 of the longitudinal central section. Preferably, the longitudinal central section and the prongs have coplanar top and bottom surfaces. Most preferably, the top 68, 69 and bottom 70, 71 surfaces of the packaging device are parallel to one another. The dimensional features set forth above with respect to the embodiment illustrated in FIGS. 1-3 apply as well to the embodiment shown in FIGS. 5 and 6.

Figure 7:
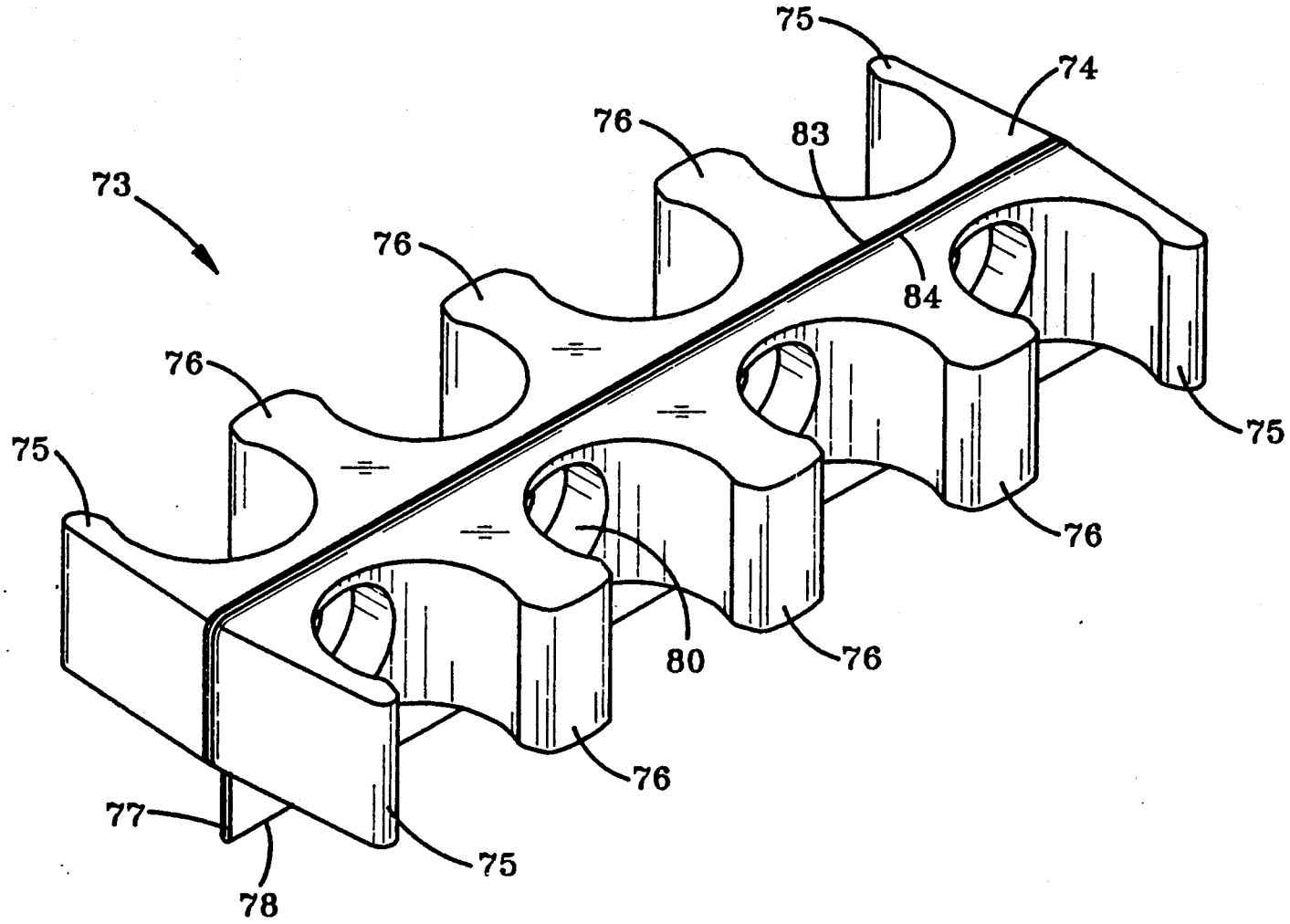
Figure 8:
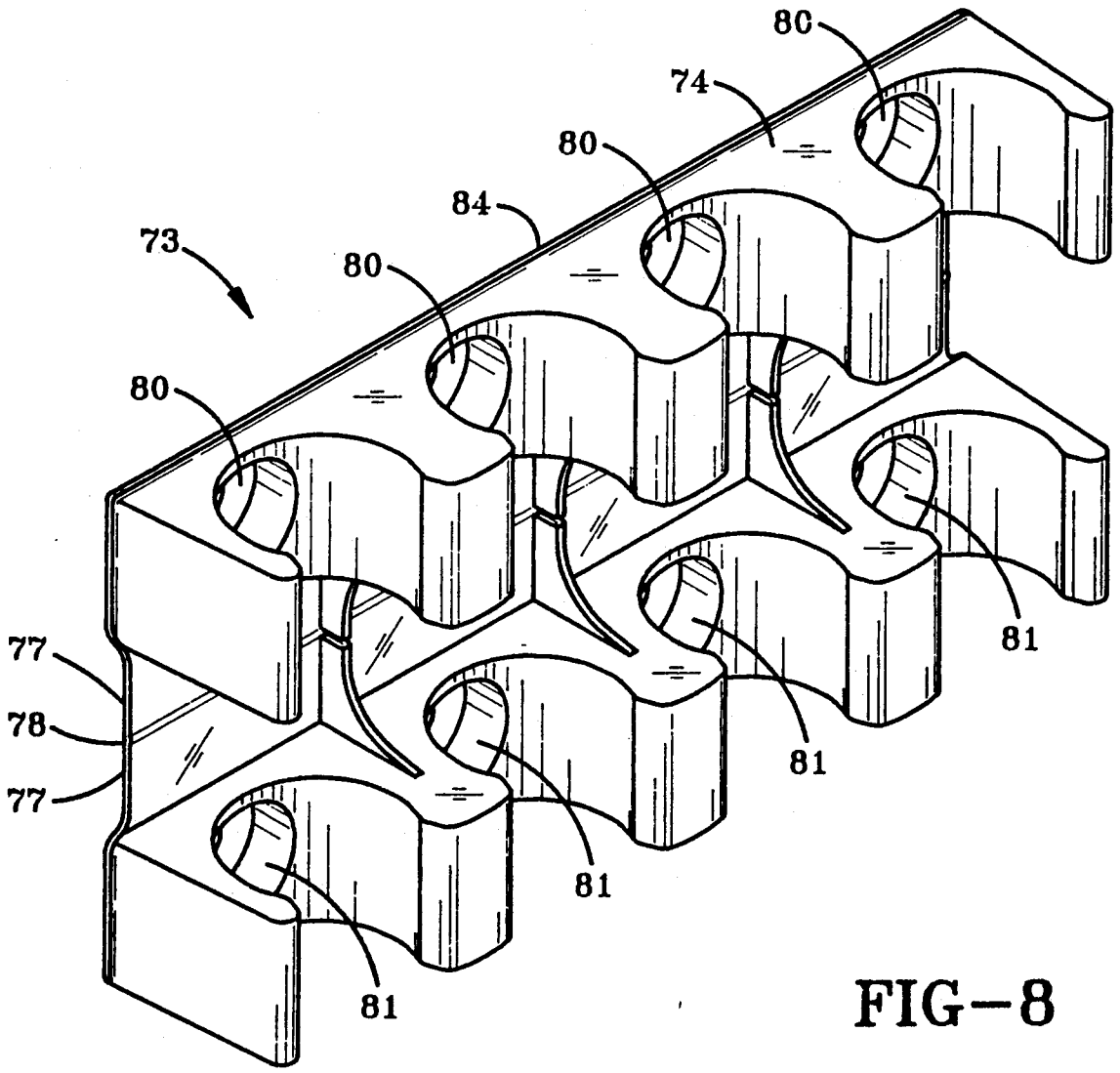
Figure 9:
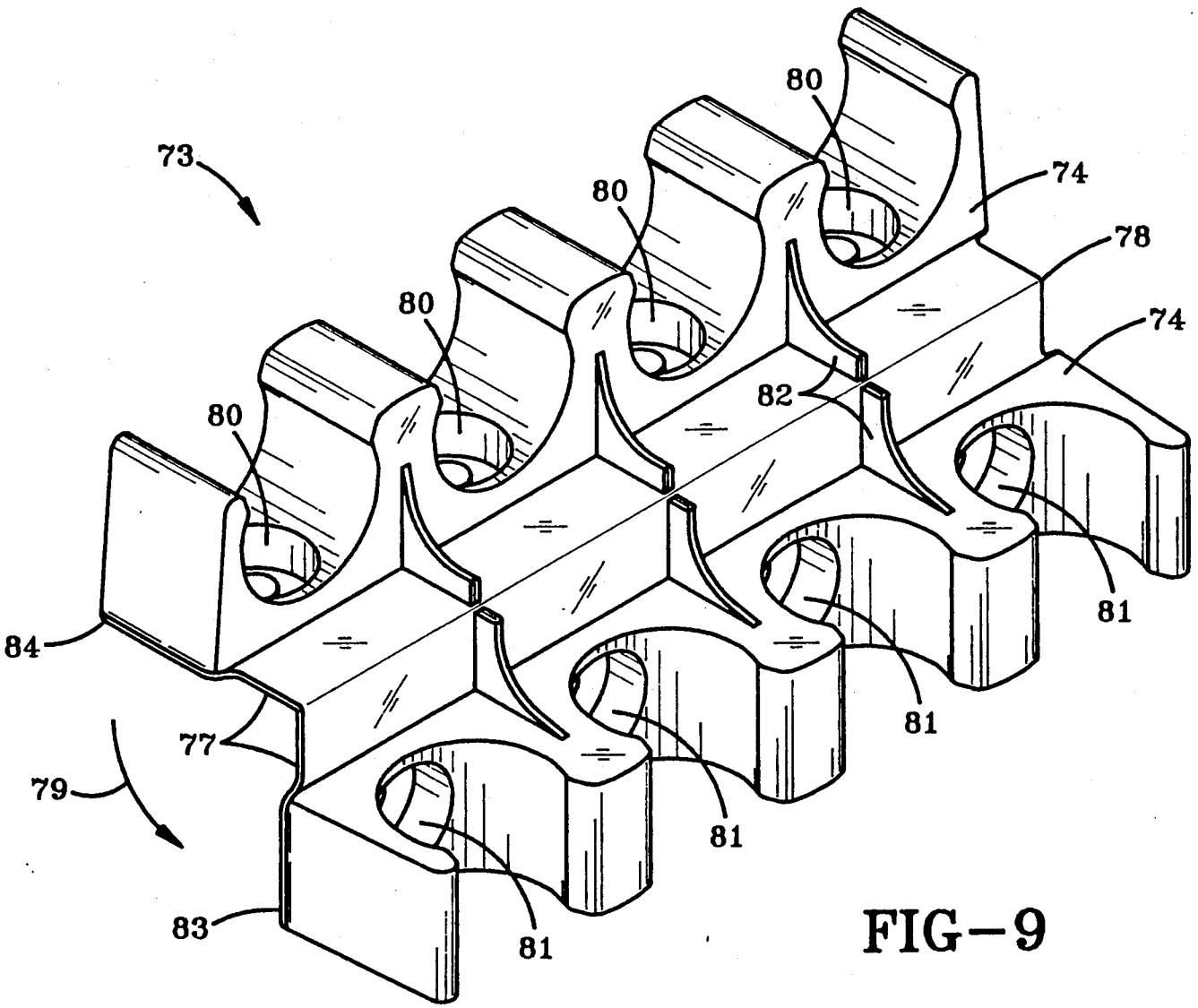

Referring next to FIGS. 7-9 there is shown a packaging device 73 according to another alternative embodiment of the invention. This embodiment is distinguishable from the earlier described embodiments inasmuch as it is hollow. The packaging device 73 has a longitudinal central section 74 with gripping members 75, 76 integral therewith and extending therefrom. The gripping members 75 nearest the ends of the longitudinal central section each have only one gripping surface, and the other gripping members 76 each have two gripping surfaces which are located on opposite sides of the gripping member. A packaging device according to this embodiment has been manufactured of clear polyethylene terephthalate glycol copolymer using a thermoforming process. Other suitable materials are high impact polystyrene, polyvinyl chloride and polyethylene terephthalate. The device is molded in a single piece having the form illustrated in FIG. 8. The two longitudinal halves of the device are joined together by a rib 77. The two halves are then folded together along a fold line 78 as indicated by arrow 79 in FIG. 9, which shows the device partially folded. When the device is folded into its operative configuration locking means 80, 81 located in each half of the device secure the edges 83, 84 of two halves in abutting relationship to one another. While the locking means 80, 81 in this example are interference fit male/female portions having round shapes, it is understood that any suitable configuration of this type or any other suitable locking means including an adhesive could be employed for securing the two halves in place. Stiffening ribs 82 may be employed to strengthen the device. The dimensional features of a packaging device which have already been discussed herein apply also to this embodiment.

Figure 10:
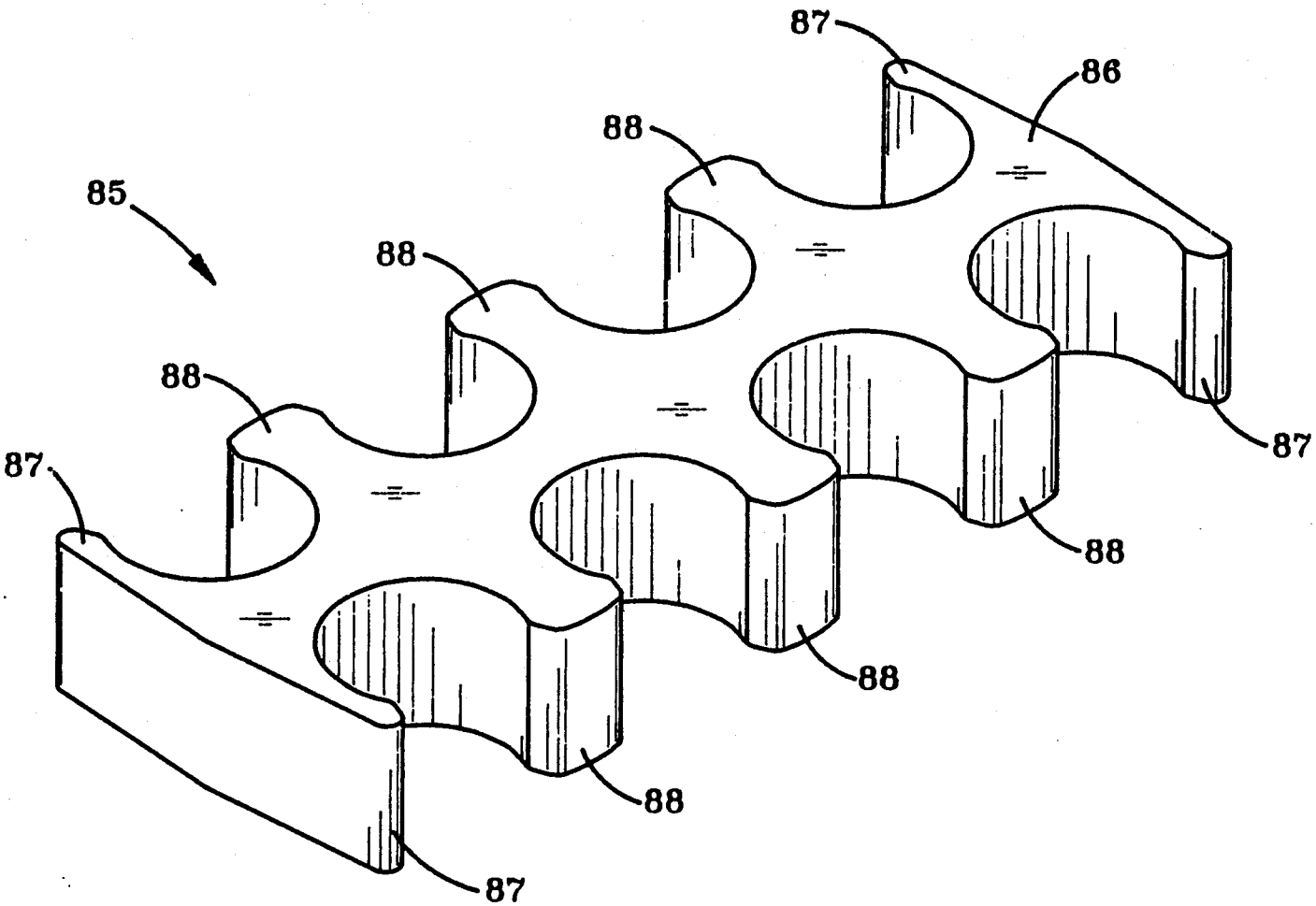

Referring next to FIG. 10, there is shown another alternative embodiment of a packaging device according to the invention. The device 85 is illustrated in a perspective view with the understanding that preferably the right and left halves as well as the top and bottom halves of the device are symmetrical. A device 85 according to this embodiment has a longitudinal central section 86 with gripping means 87, 88 integral therewith and extending therefrom. The gripping members 87 nearest the ends of the longitudinal central section each have only one gripping surface, and the other gripping members 88 each have two gripping surfaces which are located on opposite sides of the gripping member. The dimensional features of a packaging device which have already been discussed herein apply also to this embodiment. A packaging device according to this embodiment may be a solid structure comprising a compressible material such as expanded polystyrene foam or polyethylene, which imparts resiliency to the gripping members. Alternatively, a packaging device according to this embodiment may be a hollow structure comprising for example polypropylene, polyvinyl chloride, polyethylene terephthalate glycol copolymer, or polyethylene and be manufactured by a blow molding process.

Figure 11:
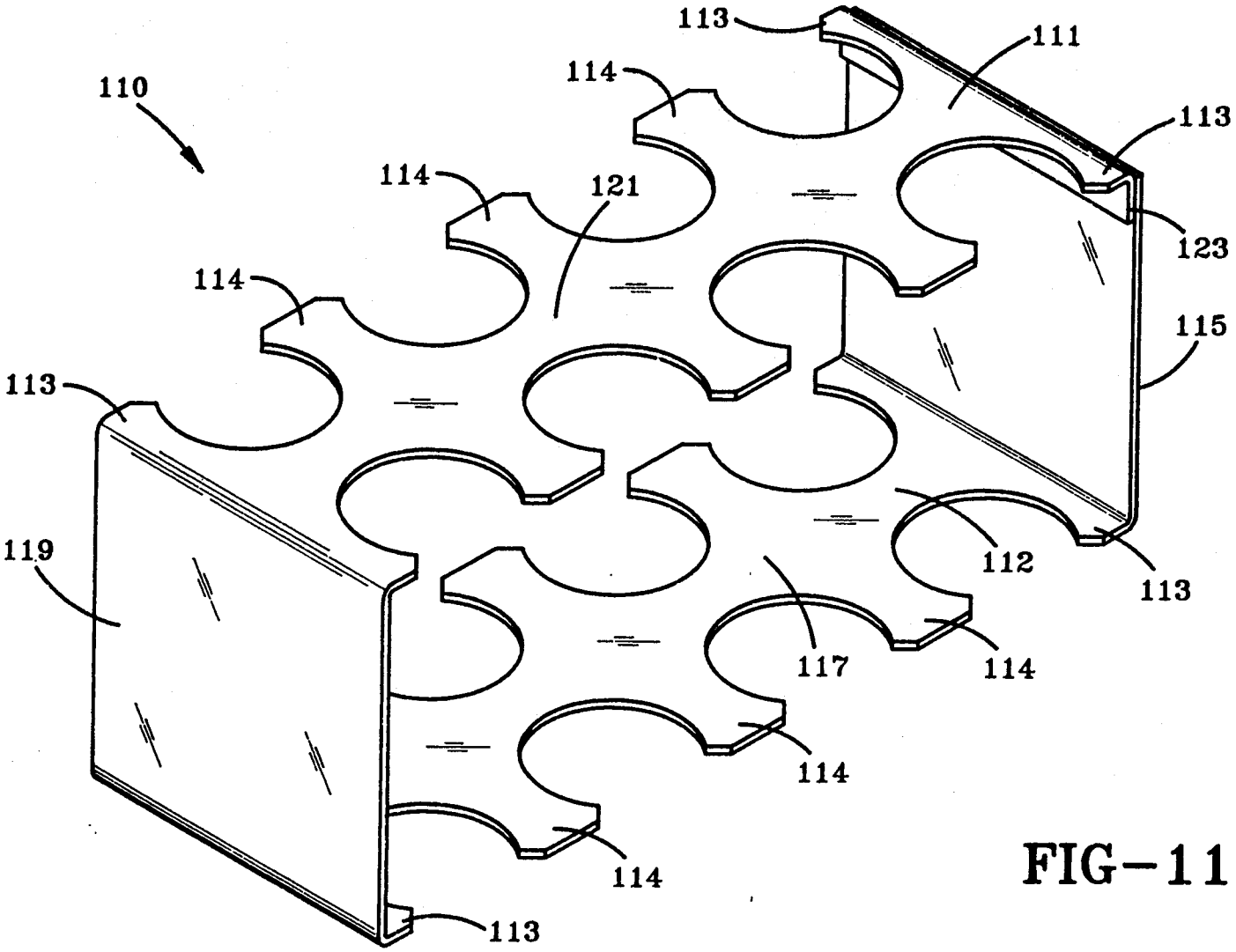

Referring next to FIG. 11 there is shown a packaging device 110 according to another alternative embodiment. A packaging device according to this embodiment has two longitudinal central sections 111, 112 which are the same and extend parallel to one another, the two longitudinal section portions 111, 112 are joined to one another by connecting end portions 115, 119. The openings formed by the pairs of gripping members 113, 114 associated with each of the longitudinal central sections are aligned with the openings formed by the pairs of gripping members associated with the other longitudinal central section to facilitate the retention of containers, by gripping each container in two locations. The gripping members 113 nearest the ends of the longitudinal central sections each have only one gripping surface, and the other gripping members 114 each have two gripping surfaces which are located on opposite sides of the gripping member. The dimensional features of a packaging device which have already been discussed herein apply also to this embodiment.

Figure 12:
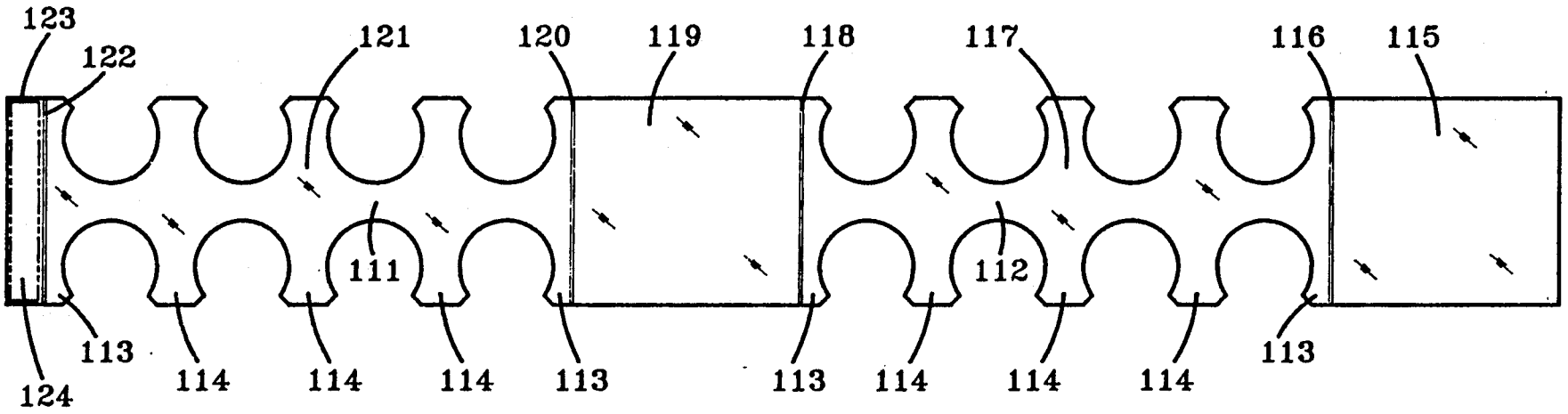

A packaging device 110 according to the embodiment illustrated in FIG. 11 may be manufactured from paperboard having a thickness of about 0.25 mm (0.10 inch) to 1.52 mm (0.60 inch), preferably 0.71 mm (0.028 inch) to 0.81 mm (0.32 inch), with the thickness selected being dependent upon the total weight of a packaging assembly. A preferred method of manufacturing is to die cut a blank having the shape shown in FIG. 12 from a sheet of paperboard and then fold it into the operative configuration. First, connecting end portion 119 is folded about fold line 118 to form a right angle with longitudinal central section 117. Next, longitudinal central section 121 is folded about fold line 120 to form a right angle with connecting end portion 119. Next, flap 123 is folded about fold line 122 to form a right angle with longitudinal central section 121 and connecting end portion 115 is folded about fold line 116 to form a right angle with longitudinal central section 117. An adhesive is applied to adhesive area 124 of the flap 123, and the flap is adhered to the connecting end portion 115.

Referring next to FIG. 13 there is shown yet another alternative embodiment of a packaging device 127 according to the invention. In this embodiment the longitudinal central section 128 comprises metal or plastic rod formed into a longitudinally elongated endless loop, with the gripping means 129 extending therefrom in the manner already described herein. The dimensional features of a packaging device which have already been discussed herein apply also this embodiment.

Referring next to FIGS. 14–17 there are shown respectively perspective, side, top and end views of a packaging assembly 100 employing a packaging device 101 according to the preferred embodiment shown in FIGS. 1–3 and already described herein. The packaging assembly comprises a packaging device 101 and two rows of containers 102. The openings formed by each of the pairs of prongs 103 has a container clampingly retained therein. The containers illustrated in this embodiment are relatively small, having a capacity of about two fluid ounces. Such containers have utility for containing liquid pediatric nutritional products. Each of the containers 102 is substantially a hollow cylinder 106 having a solid bottom 104 and a cap 105 attached to a top portion of the container. Both the cap 105 and the bottom 104 of the container have outside diameters that are greater than the outside diameter of the cylindrical portion 106 of the container. Each container is located with respect to the packaging device such that the cap 105 is on the opposite side of the packaging device 101 from the bottom 104 of the container.

If desired a packaging assembly according to the invention could be enclosed in plastic wrap; or could even have the bottoms of the containers resting in a tray, with that entire assembly enclosed in plastic wrap.

Figure 18:
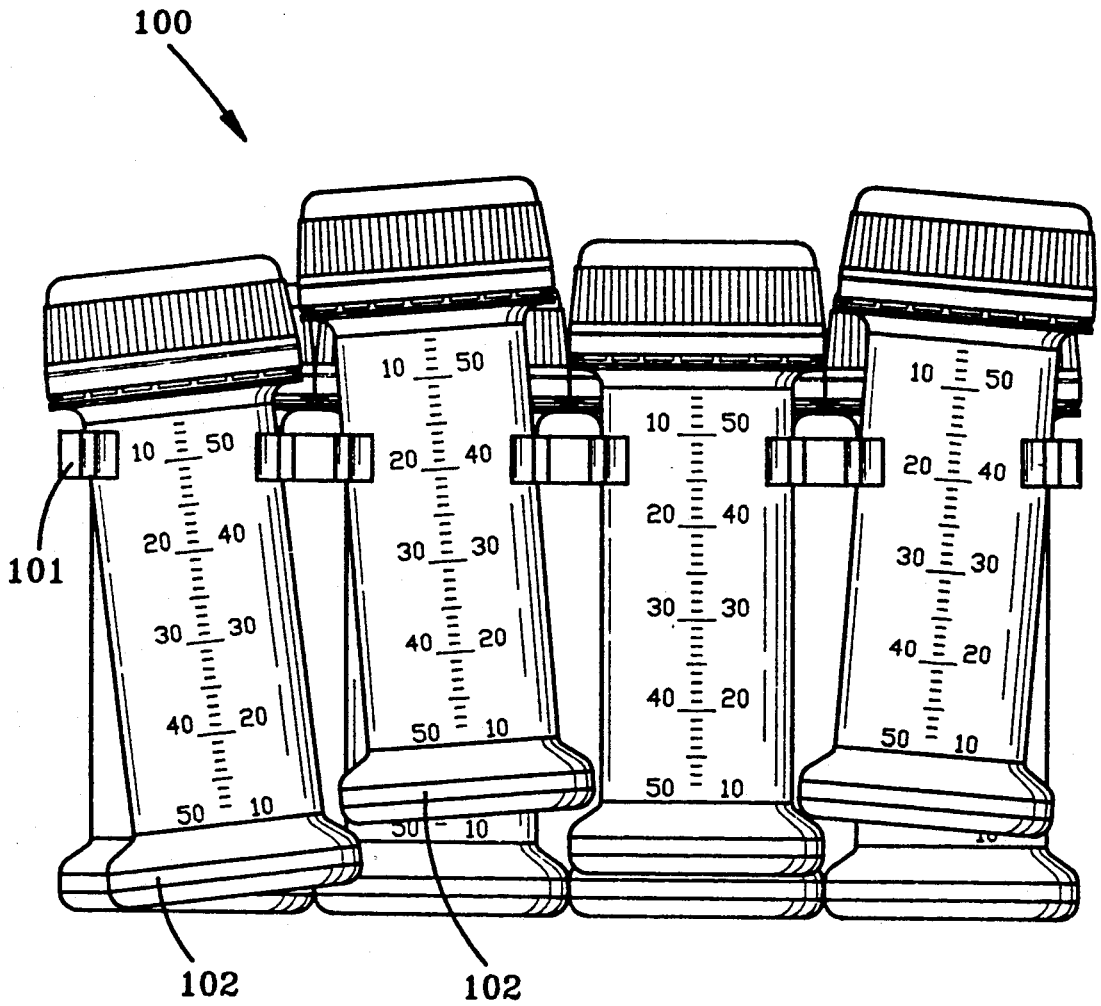
FIG. 18 is a side view of a packaging assembly according to the invention wherein the containers are in disarray.

FIG. 18 may be used to illustrate another advantage of a packaging assembly 100 according to the embodiment shown in FIGS. 14–17. Even if the containers 102 should become slightly disarrayed in a vertical manner, a horizontal manner, or both, the packaging device 101 will still retain the containers as an assembly. It is to be expected that a packaging assembly will be jostled during manufacturing, shipping, storage and so forth.

Figure 19:
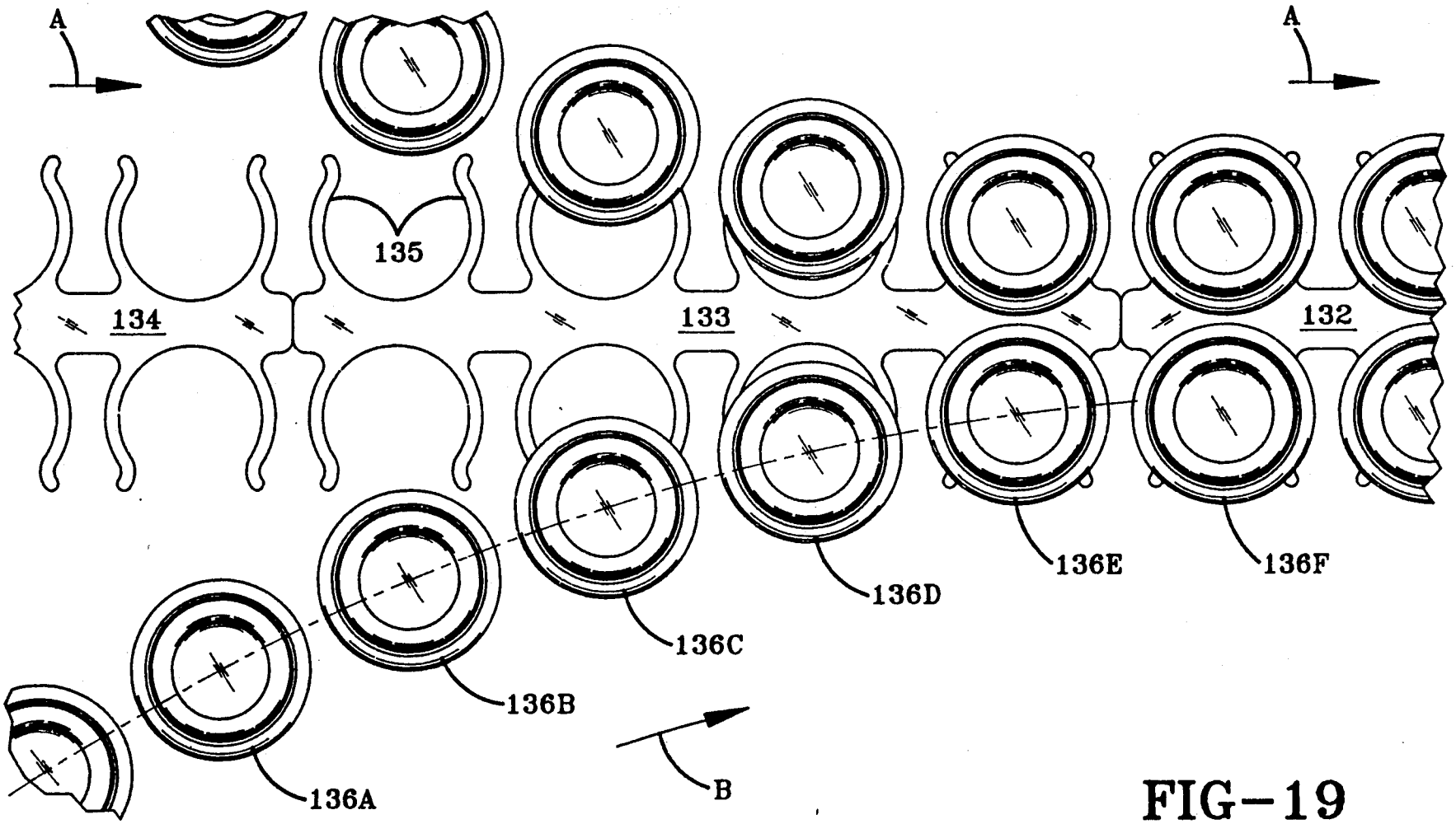
FIG. 19 is a diagrammatic representation of the manufacture of packaging assemblies according to the invention.
Figure 20:
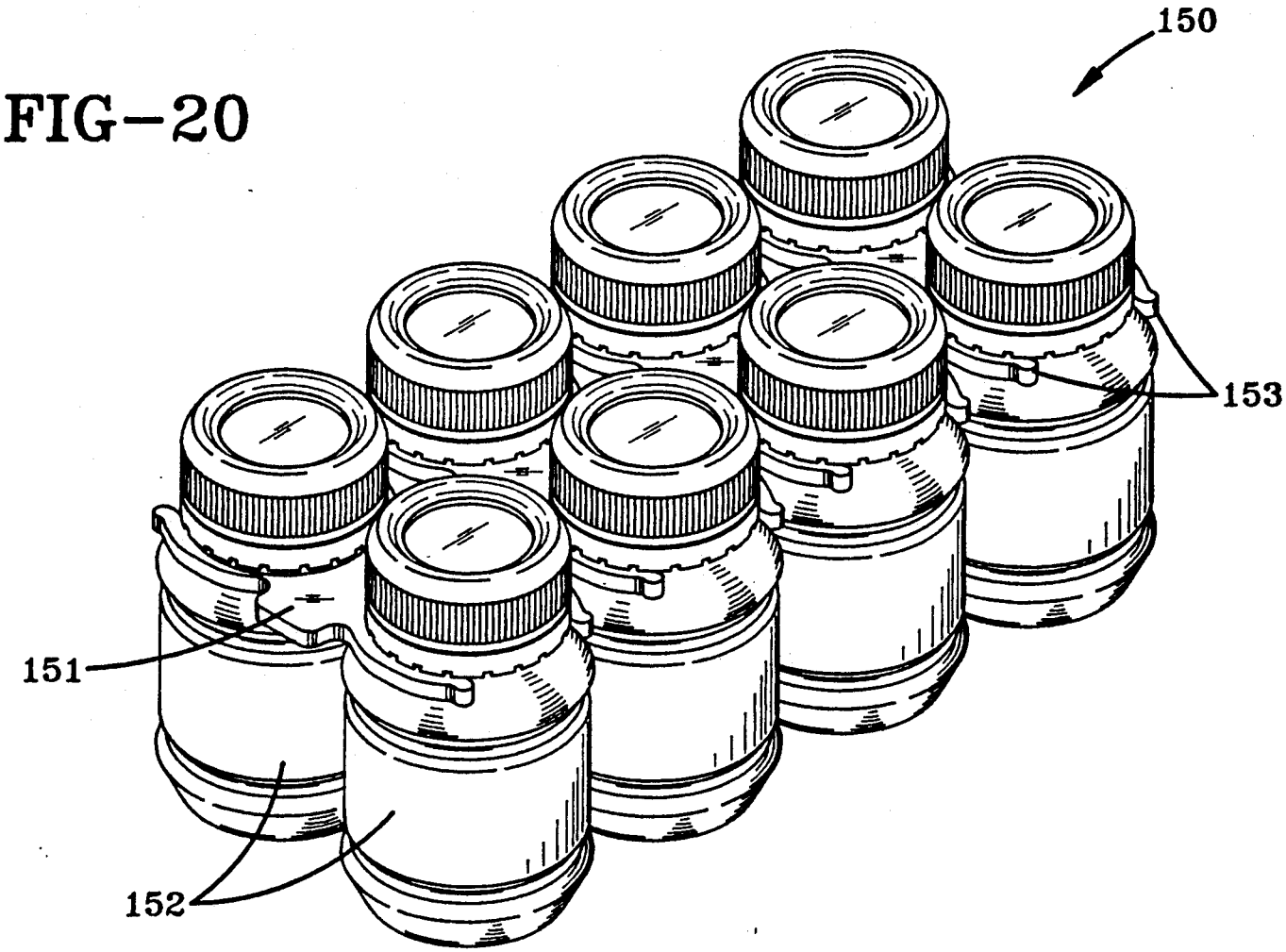
FIGS. 20–25 illustrate packaging assemblies according to other embodiments of the invention.
Figure 22:
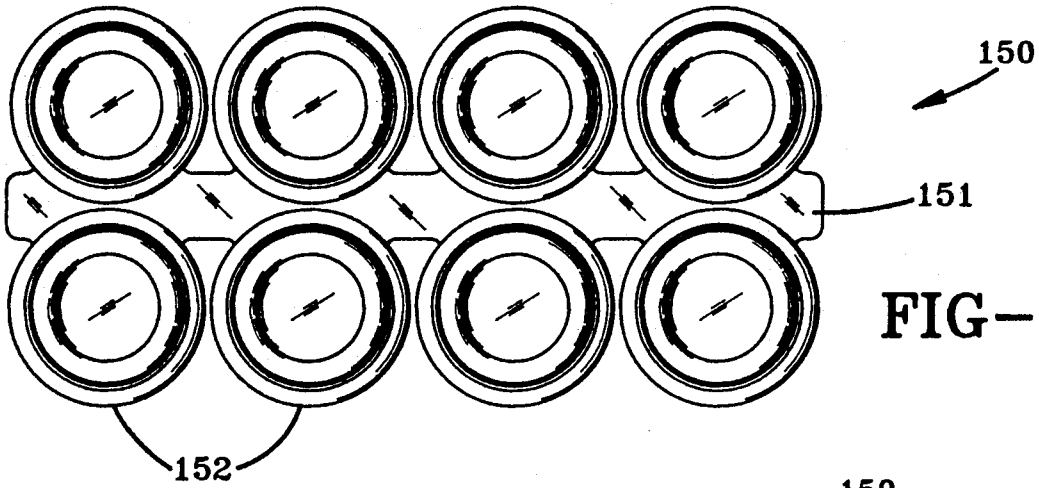
Figure 23:
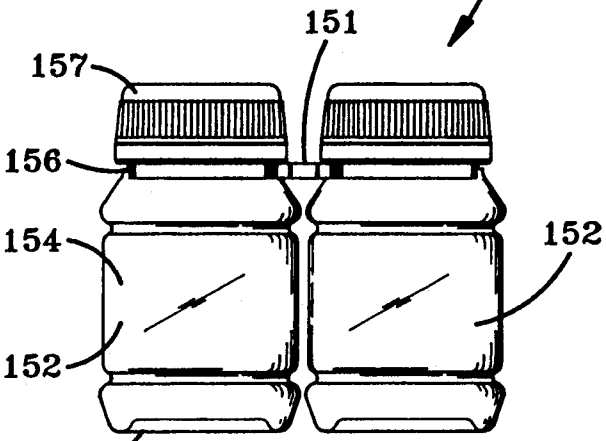
Figure 21:
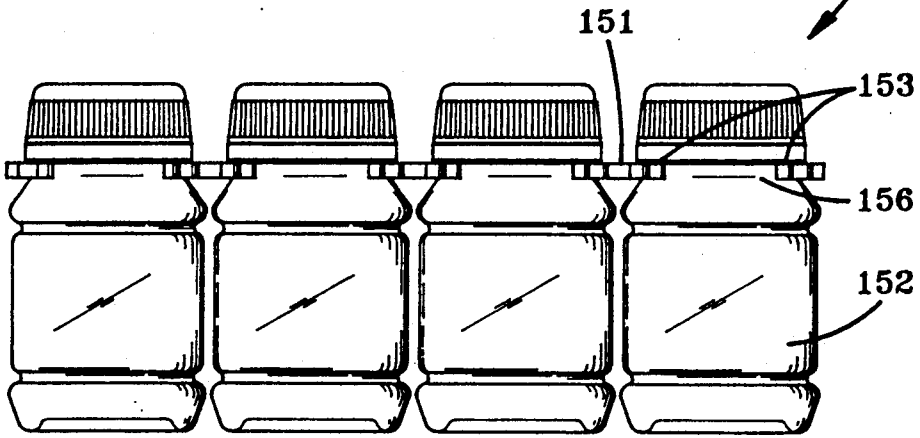

FIG. 19 is a diagrammatic representation of the manufacture of packaging assemblies according to the invention. In the actual assembling of this packaging assembly, a plurality of packaging devices 132, 133, 134 are oriented such that an end of one packaging device is directly adjacent an end of an adjacent packaging device. The orientation of these adjacent packaging devices and the dimensioning of each respective device as already described herein with reference to FIG. 2 results in a situation where the distance between the openings formed by pairs of gripping members 135 is constant even with respect to the gripping members of adjacent packaging devices.

Thus, when the packaging devices are proceeding in direction A, the introduction of sufficient pressure on the containers in direction B by any suitable means such as a belt or rollers results in the containers 136A–136F slightly pushing apart the resilient portions of the prongs 135 of the gripping means so as to effect retention therein as can be seen in the right portion of FIG. 19.

Referring to FIGS. 20–23 there are shown respectively perspective, side, top and end views of a packaging assembly 150 employing a packaging device 151 according to the embodiment shown in FIGS. 5 and 6 and already described herein. This packaging assembly comprises a packaging device 151 and two rows of containers 152. The openings formed by each of the pairs of prongs 153 has a container clampingly retained therein. The containers 152 illustrated are relatively small, having a capacity of about four fluid ounces. For purpose of example only, the containers illustrated are made of a transparent material. Such containers have utility for containing liquid pediatric nutritional products. Each of the containers 152 is substantially a hollow cylinder 154 having a solid bottom 155 with an upper portion 156 of the container being necked down and a cap 157 attached to a top portion of the necked down portion 156. The cap 157 has an outside diameter that is larger than the outside diameter of the necked down portion 156 of the container. The necked down portion 156 of the container has a smaller outside diameter than the cylindrical portion 154 of the container. Each container is disposed with respect to the packaging device such that the cap is on the opposite side of the packaging device from the bottom of the container. The necked down portion 156 of each container is gripped by a pair of prongs 153 of the packaging device. When this type of a container is employed in a packaging assembly according to the invention the container is restrained from excessive vertical movement with respect to the packaging device by the inability of the cap and cylindrical body to pass vertically through the opening presented by a pair of prongs.

The utility of the present invention with respect to packaging assemblies comprising larger containers is illustrated in FIGS. 24 and 25. The containers 160 in the packaging assembly 161 shown in FIG. 24 are about the size of sixteen ounce bottles used for beverages. The longitudinal central portion 162 of the packaging device 163 has apertures 164 therethrough for grasping the assembly and carrying it. The containers 170 in the packaging assembly 171 shown in FIG. 25 are about the size of two liter bottles used for beverages. The longitudinal central portion 172 of the packaging device 173 has a handle 174 integral therewith for grasping the assembly and carrying it.

It is to be understood that the invention is not limited to the precise embodiments disclosed herein and that changes may be made therein without departing from the scope of the invention which is defined in the appended claims.

What is claimed is:

1. A packaging device for retaining a plurality of containers, said device comprising a longitudinal central section and a plurality of means for gripping containers integral therewith, each of said gripping means comprising a pair of opposed resilient gripping members with opposite sides of said longitudinal central section having at least two of said paris of gripping members extending therefrom, each gripping member of each said pair of gripping members having a gripping surface and each pair of gripping members forming an opening for receiving and retaining a container, each said opening having a centerline that is perpendicular to a longitudinal axis of said longitudinal central section and is colinear with the centerline of an opening located on the opposite side of said longitudinal axis, said longitudinal central section having a pair of opposed longitudinal ends which are each disposed longitudinally outwardly of the nearest gripping members, and the distance between the centerlines of the openings formed by any next adjacent pairs of gripping members is twice as large as the distance between each said longitudinal end and the centerline of the openings formed by the nearest pairs of gripping members, as measured along the longitudinal axis of the longitudinal central section.

2. A packaging device according to claim 1 wherein each of said resilient gripping members has only one gripping surface.

3. A packaging device according to claim 1 wherein the gripping members nearest the ends of the longitudinal central section each have only one gripping surface, and the other gripping members each have two gripping surfaces which are located on opposite sides of the gripping member.

4. A packaging device according to claim 2 wherein said longitudinal central section comprises an interior support portion surrounded by a raised peripheral wall portion with said gripping members being integral extensions of the peripheral wall.

5. A packaging device according to claim 4 wherein the peripheral wall extends beyond both sides of the interior support portion and the gripping members have the same height as the peripheral wall.

6. A packaging device according to any one of claims 5 to 7 wherein said longitudinal central section has apertures therethrough.

7. A packaging device according to claim 3 wherein the packaging device is hollow.

8. A packaging device according to claim 3 further comprising a second longitudinal central section having a plurality of means for gripping containers integral therewith, each of said gripping means comprising a pair of opposed resilient gripping members with opposite sides of the second longitudinal central sections having at least one of said pairs of gripping members extending therefrom, each pair of gripping members forming an opening for receiving and retaining a container, said longitudinal central section being parallel to one another and joined to one another by connecting end portions, and the openings formed by the pairs of gripping members associated with each of the longitudinal central sections being aligned with the openings formed by the pairs of gripping members associated with the other longitudinal central section.

9. A packaging device for retaining a plurality of containers, said device comprising a longitudinal central section and a plurality of pairs of opposed resilient prongs arranged along opposite sides of said longitudinal central section and integral therewith; each prong of each said pair of prongs having a gripping surface that is concave with respect to the other prong of the same pair such that each pair of prongs forms an opening for receiving and retaining a container, each said opening having a centerline that is perpendicular to a longitudinal axis of said longitudinal central section and is colinear with the centerline of an opening located on the opposite side of said longitudinal axis, said longitudinal central section having a pair of opposed longitudinal ends which are each disposed longitudinally outwardly of the nearest prongs, and the distance between the centerlines of the openings formed by any next adjacent pairs of prongs is twice as large as the distance between each said longitudinal end and the centerline of the openings formed by the nearest pairs of prongs, as measured along the longitudinal axis of the longitudinal central section.

10. A packaging device for retaining a plurality of containers, said device comprising a longitudinal central section and a plurality of pairs of prongs integral therewith, said longitudinal central section comprising a peripheral wall and an interior support portion, said peripheral wall comprising a top, a bottom, an inner face and an outer face, said interior support portion comprising a planar sheetform member which communicates with the inner face of said peripheral wall intermediate said top and bottom of said peripheral wall, a plurality of said pairs of opposed resilient prongs which are integral extensions of the peripheral wall are arranged along opposite sides of said longitudinal central section, each prong of each said pair of prongs having a gripping surface that is concave with respect to the other prong of the same pair such that each pair of prongs forms an opening for receiving and retaining a container, each of said openings having a centerline that is perpendicular to a longitudinal axis of said longitudinal central section and is colinear with the centerline of an opening located on the opposite side of said longitudinal axis, said longitudinal central section having a pair of opposed longitudinal ends which are each disposed longitudinally outwardly of the nearest prongs, and the distance between the centerlines of the openings formed by an next adjacent pairs of prongs is twice as large as the distance between each said longitudinal end and the centerline of the openings formed by the nearest pairs of prongs, as measured along the longitudinal axis of the longitudinal central section.

11. A packaging device according to either one of claims 9 or 10 wherein for each pair of prongs the gripping surface of each prong has an end that is distal from the longitudinal central portion of the device and each prong extends laterally outwardly beyond said distal end, and beginning at the distal ends of the gripping surfaces the distance between the prongs of said pair, as measured parallel to the longitudinal axis of said longitudinal central section, progressively increases as the distance from the longitudinal central section increases.

12. A packaging device according to claim 12 wherein for each pair of prongs the gripping surface of each prong has an end that is distal from the longitudinal central portion of the device and each prong extends laterally outwardly beyond said distal end, and beginning at the distal ends of the gripping surfaces the distance between the prongs of said pair, as measured parallel to the longitudinal axis of said longitudinal central section, progressively increases as the distance from the longitudinal central section increases.

13. A packaging device according to either one of claims 9 or 10 wherein said longitudinal central section has apertures therethrough.

14. A packaging device according to either one of claims 9 or 10 further comprising a handle member.

15. A packaging assembly comprising a packaging device and two rows of containers, said packaging device comprising a longitudinal central section and a plurality of means for gripping containers integral therewith, each of said gripping means comprising a pair of opposed resilient gripping members with a plurality of said pairs of gripping members disposed along opposite sides of said longitudinal central section, each gripping member of each said pair of gripping members having a gripping surface and each said pair of gripping members forming an opening having a container retained therein, each of the openings formed by a pair of gripping members having a centerline that is perpendicular to a longitudinal axis of said central section and is colinear with the centerline of an opening formed by a pair of gripping members located on the opposite side of said longitudinal axis, said central section having a pair of opposed longitudinal ends which are each disposed longitudinally outwardly of the nearest gripping members, and the distance between the centerlines of the openings formed by any next adjacent pairs of gripping members is twice as large as the distance between each of said longitudinal ends and the centerline of the openings formed by the nearest pairs of gripping members, as measured along the longitudinal axis of the longitudinal central section.

16. A packaging assembly comprising a packaging device and two rows of containers, said packaging device comprising a longitudinal central section and a plurality of pairs of opposed resilient prongs disposed along opposite side of said longitudinal central section and integral therewith; each prong of each said pair of prongs having a gripping surface that is concave with respect to the other prong of the same pair such that each pair of prongs forms an opening having a container retained therein, each of the openings formed by a pair of prongs having a centerline that is perpendicular to a longitudinal axis of said central section and is colinear with the centerline of an opening formed by a pair of prongs located on the opposite side of said longitudinal axis, said central section having a pair of opposed longitudinal ends which are each disposed longitudinally outwardly of the nearest prongs, and the distance between the centerlines of the opening formed by any next adjacent pairs of prongs is twice as large as the distance between each said longitudinal end and the centerline of the openings formed by the nearest pairs of prongs, as measured along the longitudinal axis of the longitudinal central section.

17. A packaging assembly comprising a packaging device and two rows of containers, said device comprising a longitudinal central section and a plurality of pairs of prongs integral therewith, said longitudinal central section comprising a peripheral wall and an interior support portion, said peripheral wall comprising a top, a bottom, an inner face and an outer face, said interior support portion comprising a planar sheetform member which communicates with the inner face of said peripheral wall intermediate said top and bottom of said peripheral wall, a plurality of said pairs of opposed resilient prongs which are integral extensions of the peripheral wall are arranged along opposite sides of said longitudinal central section, each prong of each said pair of prongs having a gripping surface that is concave with respect to the other prong of the same pair such that each pair of prongs forms an opening having a container retained therein, each of the openings formed by a pair of prongs having a centerline that is perpendicular to a longitudinal axis of said central section and is colinear with the centerline of an opening formed by a pair of prongs located on the opposite side of said longitudinal axis, said central section having a pair of opposed longitudinal ends which are each disposed longitudinally outwardly of the nearest prongs, and the distance between the centerlines of the openings formed by an next adjacent pairs of prongs is twice as large as the distance between each said longitudinal end and the centerline of the openings formed by the nearest paris of prongs, as measured along the longitudinal axis of the longitudinal central section.

18. A packaging assembly comprising a packaging device and two rows of containers, said packaging device comprising a longitudinal central section and a plurality of pairs of opposed resilient prongs arranged along opposite sides of said longitudinal central section and integral therewith; the prongs having top surfaces which are a continuation of a top surface of the longitudinal central section and bottom surfaces which are a continuation of a bottom surface of the longitudinal central section, each prong of each said pair of prongs having a gripping surface that is concave with respect to the other prong of the same pair such that each pair of prongs forms an opening having a container retained therein, each of the openings formed by a pair of prongs having a centerline that is perpendicular to a longitudinal axis of said central section and is colinear with the centerline of an opening formed by a pair of prongs located on the opposite side of said longitudinal axis, said longitudinal central section having a pair of opposed longitudinal ends which are each disposed longitudinally outwardly of the nearest prongs, and the distance between the centerlines of the openings formed by any next adjacent pairs of prongs is twice as large as the distance between each said longitudinal end and the centerline of the openings formed by the nearest pairs of prongs, as measured along the longitudinal axis of the longitudinal central section.

19. A packaging assembly according to any one of claims 16–19 wherein each said container comprises a hollow body having a solid bottom with a cap attached to a top portion of the container, and for each container the cap is on an opposite side of said packaging device from the bottom of the container.

20. A packaging assembly according to any one of claims 16–18 wherein each said container comprises a tially hollow cylinder having a solid bottom with a cap attached to a top portion of the container, both the cap and the bottom of the container having outside diameters that are greater than the outside diameter of said cylinder, and for each container the cap is on the opposite side of the packaging device from the bottom of the container.

21. A packaging assembly according to any one of claims 16–19 wherein each said container is substantially a hollow cylinder having a solid bottom with an upper portion of the container being necked down and a cap attached to a top portion of said necked down portion, the cap having an outside diameter that is larger than the outside diameter of said necked down portion, and the necked down portion of the container is gripped by a pair of prongs of said packaging device.

22. A packaging assembly according to any one of claims 16–19 wherein the longitudinal central section of the packaging device has apertures therethrough.

23. A packaging assembly according to any one of claims 16–19 wherein said packaging device further comprises a handle member.

* * * * *

UNITED STATES PATENT AND TRADEMARK OFFICE

CERTIFICATE OF CORRECTION

PATENT NO. : 5,191,975

DATED : March 9, 1993

INVENTOR(S) : Paul A. Pezzoli, Antonino Araujo, Jr. and Raymond W. Hazlett

It is certified that error appears in the above-indentified patent and that said Letters Patent is hereby corrected as shown below:

Column 14, line 2, claim 19, "16-19" should be --15-18--.

Column 14, line 2, claim 20, "16-18" should be --15-18-- and in the third line "tially" should be --substantially--.

Column 14, line 37, "Comprises a" should read --is substantially --.

Column 14, line 2, claim 21, "16-19" should be --15-18--.

Column 14, line 2, claim 22, "16-19" should be --15-18--.

Column 14, line 2, claim 23, "16-19" should be --15-18--.

Signed and Sealed this

Twenty-eighth Day of December, 1993

Bruce Lehman

*Attest:*

BRUCE LEHMAN

*Attesting Officer*

*Commissioner of Patents and Trademarks*